US005949003A

United States Patent [19]

Aoki et al.

[11] Patent Number: 5,949,003

[45] Date of Patent: Sep. 7, 1999

[54] HIGH-TEMPERATURE WEAR-RESISTANT SINTERED ALLOY

[75] Inventors: Yoshimasa Aoki; Kei Ishii; Koichiro Hayashi; Kouichi Aonuma; Hideaki Kawata, all of Chiba; Kunio Maki, Yokohama; Atsushi Ehira, Kanagawa; Akira Fujiki; Sadayuki Abo, both of Yokohama; Seigo Sato, Kanagawa, all of Japan

[73] Assignees: Nissan Motor Co., Ltd., Kanagawa; Hitachi Powdered Metals Co., Ltd., Chiba, both of Japan

[21] Appl. No.: 08/833,195

[22] Filed: Apr. 14, 1997

[30] Foreign Application Priority Data

Apr. 15, 1996 [JP] Japan ..... 8-092752
Mar. 12, 1997 [JP] Japan ..... 9-057943

[51] Int. Cl.[6] ..... C22C 33/00

[52] U.S. Cl. ..... 75/246; 75/231; 75/243

[58] Field of Search ..... 75/231, 243, 246

[56] References Cited

U.S. PATENT DOCUMENTS

| | | | |
|---|---|---|---|
| 4,121,927 | 10/1978 | Lohman et al. . | |
| 4,504,312 | 3/1985 | Oaku et al. | 75/244 |
| 4,505,988 | 3/1985 | Urano et al. | 428/569 |
| 4,552,590 | 11/1985 | Nakata et al. | 75/246 |
| 5,031,878 | 7/1991 | Ishikawa et al. | 251/368 |
| 5,462,573 | 10/1995 | Baker et al. | 75/231 |
| 5,756,909 | 5/1998 | Liimatainen et al. | 75/238 |

FOREIGN PATENT DOCUMENTS

| | | |
|---|---|---|
| 0 339 436 A1 | 11/1989 | European Pat. Off. . |
| 26 45 574 A1 | 7/1977 | Germany . |
| 63-223147 | 9/1988 | Japan . |
| 1-51539 | 11/1989 | Japan . |
| 5-9667 | 1/1993 | Japan . |
| 5-55593 | 8/1993 | Japan . |
| 7-233454 | 9/1995 | Japan . |
| 2116207 | 3/1982 | United Kingdom . |

OTHER PUBLICATIONS

Foreign Search Report.

*Primary Examiner*—Ngoclan Mai
*Attorney, Agent, or Firm*—McDermott, Will & Emery

[57] ABSTRACT

The invention relates to a sintered alloy. This sintered alloy includes 3–13.4 wt % of W, 0.4–5.6 wt % or 0.8–5.9 wt % of V, 0.2–5.6 wt % of Cr, 0.1–0.6 wt % or 0.6–5.0 wt % of Si, 0.1–0.6 wt % or 0.2–1.0 wt % of Mn, 0.6–2.2 wt % of C, and a balance of Fe. The sintered alloy includes first and second phase which are distributed therein, in a form of spots, respectively. The second phase is in an amount of from 20 to 80 wt %, based on the total weight of the first and second phases. The first phase contains 3–7 wt % of W, 0.5–1.5 wt % of optional V, up to 1 wt % of Cr, 0.1–0.6 wt % or 0.6–5.0 wt % of Si, 0.1–0.6 wt % or 0.2–1.0 wt % of Mn, up to 2.2 wt % of C, and a balance of Fe. The second phase contains 3–15 wt % of W, 2–7 wt % of V, 1–7 wt % of Cr, 0.1–0.6 wt % or 0.6–5.0 wt % of Si, 0.1–0.6 wt % or 0.2–1.0 wt % of Mn, up to 2.2 wt % of C, and a balance of Fe. When the manganese contents of the first and second phases and the total of the sintered alloy are respectively in a range of from 0.2 to 1.0 wt %, sulfur is respectively contained therein in an amount of from 0.1 to 0.6 wt %. The sintered alloy has wear-resistant at high temperature and good compatibility without damaging mating part that is in contact with the sintered alloy.

13 Claims, 15 Drawing Sheets

HIGH-TEMPERATURE WEAR-RESISTANT SINTERED ALLOY

BACKGROUND OF THE INVENTION

The present invention relates to an iron-based sintered alloy which is wear-resistant at high temperature. Such sintered alloy is preferably used as a material for mechanical parts (e.g., such as valve seat insert used in internal combustion engine) that require wear resistance at high temperature.

There are various conventional wear resistant materials. For example, Japanese Patent Examined Publication JP-B-5-55593 and Japanese Patent Unexamined Publication JP-A-7-233454 disclose high-temperature wear-resistant sintered alloys each being high in cobalt content. However, the production cost of these sintered alloys is high, due to the use of relatively large amounts of cobalt.

JP-A-5-9667 discloses an iron-based sintered alloy containing an iron-based matrix and an iron-based hard phase dispersed in the matrix. The hard phase contains C, Cr, Mo, W, V, Si, and Mn. JP-B-1-51539 discloses an iron-based sintered alloy containing an iron-based matrix and a dispersed phase containing Cr, C, Mo, Si, and at least one selected from Nb, Ta, Ti and V. According to these patent publications '667 and '539, however, it is difficult to prepare a sintered alloy that is superior in wear resistance and at the same time is weak in the property of damaging another member that is in contact with the sintered alloy.

SUMMARY OF THE INVENTION

It is therefore an object of the present invention to provide a sintered alloy that has wear-resistance at high temperature and good compatibility without damaging mating part that is in contact with the sintered alloy.

According to the following first to eighth aspects of the present invention, the sintered alloy has wear-resistance at high temperature and good compatibility without damaging mating part that is in contact with the sintered alloy.

According to the first aspect of the present invention, there is provided a high-temperature wear-resistant sintered alloy comprising, based on a total weight of said sintered alloy, 3–13.4 wt % of W, 0.4–5.6 wt % of V, 0.2–5.6 wt % of Cr, 0.1–0.6 wt % of Si, 0.1–0.6 wt % of Mn, 0.6–2.2 wt % of C, and a balance of Fe. This sintered alloy includes a first phase comprising, based on a total weight of said first phase, 3–7 wt % of W, up to 1 wt % of Cr, 0.1–0.6 wt % of Si, 0.1–0.6 wt % of Mn, up to 2.2 wt % of C, and a balance of Fe; and a second phase comprising, based on a total weight of said second phase, 3–15 wt % of W, 2–7 wt % of V, 1–7 wt % of Cr, 0.1–0.6 wt % of Si, 0.1–0.6 wt % of Mn, up to 2.2 wt % of C, and a balance of Fe, said second phase being in an amount of from 20 to 80 wt %, based on a total weight of said first and second phases.

According to the second aspect of the present invention, there is provided a high-temperature wear-resistant sintered alloy comprising, based on a total weight of said sintered alloy, 3–13.4 wt % of W, 0.8–5.9 wt % of V, 0.2–5.6 wt % of Cr, 0.1–0.6 wt % of Si, 0.1–0.6 wt % of Mn, 0.6–2.2 wt % of C, and a balance of Fe. This sintered alloy includes a first phase comprising, based on a total weight of said first phase, 3–7 wt % of W, 0.5–1.5 wt % of V, up to 1 wt % of Cr, 0.1–0.6 wt % of Si, 0.1–0.6 wt % of Mn, up to 2.2 wt % of C, and a balance of Fe; and a second phase comprising, based on a total weight of said second phase, 3–15 wt % of W, 2–7 wt % of V, 1–7 wt % of Cr, 0.1–0.6 wt % of Si, 0.1–0.6 wt % of Mn, up to 2.2 wt % of C, and a balance of Fe, said second phase being in an amount of from 20 to 80 wt %, based on a total weight of said first and second phases.

According to the third aspect of the present invention, there is provided a high-temperature wear-resistant sintered alloy comprising, based on a total weight of said sintered alloy, 3–13.4 wt % of W, 0.4–5.6 wt % of V, 0.2–5.6 wt % of Cr, 0.1–0.6 wt % of Si, 0.2–1.0 wt % of Mn, 0.1–0.6 wt % of S, 0.6–2.2 wt % of C, and a balance of Fe. This sintered alloy includes a first phase comprising, based on a total weight of said first phase, 3–7 wt % of W, up to 1 wt % of Cr, 0.1–0.6 wt % of Si, 0.2–1.0 wt % of Mn, 0.1–0.6 wt % of S, up to 2.2 wt % of C, and a balance of Fe; and a second phase comprising, based on a total weight of said second phase, 3–15 wt % of W, 2–7 wt % of V, 1–7 wt % of Cr, 0.1–0.6 wt % of Si, 0.2–1.0 wt % of Mn, 0.1–0.6 wt % of S, up to 2.2 wt % of C, and a balance of Fe, said second phase being in an amount of from 20 to 80 wt %, based on a total weight of said first and second phases.

According to the fourth aspect of the present invention, there is provided a high-temperature wear-resistant sintered alloy comprising, based on a total weight of said sintered alloy, 3–13.4 wt % of W, 0.8–5.9 wt % of V, 0.2–5.6 wt % of Cr, 0.1–0.6 wt % of Si, 0.2–1.0 wt % of Mn, 0.1–0.6 wt % of S, 0.6–2.2 wt % of C, and a balance of Fe. This sintered alloy includes a first phase comprising, based on a total weight of said first phase, 3–7 wt % of W, 0.5–1.5 wt % of V, up to 1 wt % of Cr, 0.1–0.6 wt % of Si, 0.2–1.0 wt % of Mn, 0.1–0.6 wt % of S, up to 2.2 wt % of C, and a balance of Fe; and a second phase comprising, based on a total weight of said second phase, 3–15 wt % of W, 2–7 wt % of V, 1–7 wt % of Cr, 0.1–0.6 wt % of Si, 0.2–1.0 wt % of Mn, 0.1–0.6 wt % of S, up to 2.2 wt % of C, and a balance of Fe, said second phase being in an amount of from 20 to 80 wt %, based on a total weight of said first and second phases.

According to the fifth aspect of the present invention, there is provided a high-temperature wear-resistant sintered alloy comprising, based on a total weight of said sintered alloy, 3–13.4 wt % of W, 0.4–5.6 wt % of V, 0.2–5.6 wt % of Cr, 0.6–5.0 wt % of Si, 0.1–0.6 wt % of Mn, 0.6–2.2 wt % of C, and a balance of Fe. This sintered alloy includes a first phase comprising, based on a total weight of said first phase, 3–7 wt % of W, up to 1 wt % of Cr, 0.6–5.0 wt % of Si, 0.1–0.6 wt % of Mn, up to 2.2 wt % of C, and a balance of Fe; and a second phase comprising, based on a total weight of said second phase, 3–15 wt % of W, 2–7 wt % of V, 1–7 wt % of Cr, 0.6–5.0 wt % of Si, 0.1–0.6 wt % of Mn, up to 2.2 wt % of C, and a balance of Fe, said second phase being in an amount of from 20 to 80 wt %, based on a total weight of said first and second phases.

According to the sixth aspect of the present invention, there is provided a high-temperature wear-resistant sintered alloy comprising, based on a total weight of said sintered alloy, 3–13.4 wt % of W, 0.8–5.9 wt % of V, 0.2–5.6 wt % of Cr, 0.6–5.0 wt % of Si, 0.1–0.6 wt % of Mn, 0.6–2.2 wt % of C, and a balance of Fe. This sintered alloy includes a first phase comprising, based on a total weight of said first phase, 3–7 wt % of W, 0.5–1.5 wt % of V, up to 1 wt % of Cr, 0.6–5.0 wt % of Si, 0.1–0.6 wt % of Mn, up to 2.2 wt % of C, and a balance of Fe; and a second phase comprising, based on a total weight of said second phase, 3–15 wt % of W, 2–7 wt % of V, 1–7 wt % of Cr, 0.6–5.0 wt % of Si, 0.1–0.6 wt % of Mn, up to 2.2 wt % of C, and a balance of Fe, said second phase being in an amount of from 20 to 80 wt %, based on a total weight of said first and second phases.

According to the seventh aspect of the present invention, there is provided a high-temperature wear-resistant sintered alloy comprising, based on a total weight of said sintered alloy, 3–13.4 wt % of W, 0.4–5.6 wt % of V, 0.2–5.6 wt % of Cr, 0.6–5.0 wt % of Si, 0.2–1.0 wt % of Mn, 0.1–0.6 wt % of S, 0.6–2.2 wt % of C, and a balance of Fe. This sintered alloy includes a first phase comprising, based on a total weight of said first phase, 3–7 wt % of W, up to 1 wt % of Cr, 0.6–5.0 wt % of Si, 0.2–1.0 wt % of Mn, 0.1–0.6 wt % of S, up to 2.2 wt % of C, and a balance of Fe; and a second phase comprising, based on a total weight of said second phase, 3–15 wt % of W, 2–7 wt % of V, 1–7 wt % of Cr, 0.6–5.0 wt % of Si, 0.2–1.0 wt % of Mn, 0.1–0.6 wt % of S, up to 2.2 wt % of C, and a balance of Fe, said second phase being in an amount of from 20 to 80 wt %, based on a total weight of said first and second phases.

According to the eighth aspect of the present invention, there is provided a high-temperature wear-resistant sintered alloy comprising, based on a total weight of said sintered alloy, 3–13.4 wt % of W, 0.8–5.9 wt % of V, 0.2–5.6 wt % of Cr, 0.6–5.0 wt % of Si, 0.2–1.0 wt % of Mn, 0.1–0.6 wt % of S, 0.6–2.2 wt % of C, and a balance of Fe. This sintered alloy includes a first phase comprising, based on a total weight of said first phase, 3–7 wt % of W, 0.5–1.5 wt % of V, up to 1 wt % of Cr, 0.6–5.0 wt % of Si, 0.2–1.0 wt % of Mn, 0.1–0.6 wt % of S, up to 2.2 wt % of C, and a balance of Fe; and a second phase comprising, based on a total weight of said second phase, 3–15 wt % of W, 2–7 wt % of V, 1–7 wt % of Cr, 0.6–5.0 wt % of Si, 0.2–1.0 wt % of Mn, 0.1–0.6 wt % of S, up to 2.2 wt % of C, and a balance of Fe, said second phase being in an amount of from 20 to 80 wt %, based on a total weight of said first and second phases.

According to each of the first to eighth aspects of the present invention, the first and second phases of the sintered alloy are distributed therein, in the form of spots, respectively.

According to the ninth aspect of the present invention, the sintered alloy of the first, second, fifth or sixth aspect of the present invention may comprise 0.3–1.6 wt % of MnS that is distributed in a boundary between a first grain of the first phase and a second grain of the second phase and/or in a pore of the sintered alloy.

BRIEF DESCRIPTION OF THE DRAWINGS

FIG. 10 is a graph similar to FIG. 9, but showing the radial crushing strength of each sintered alloy versus that;

FIG. 13 is a graph similar to FIG. 12, but showing the density of the compact of each powder mixture versus that;

FIG. 14 is a graph similar to FIG. 12, but showing the maximum cutting force of each sintered alloy versus that;

FIG. 14*b* is a graph similar to FIG. 14*a*, but showing the density of the compact of each powder mixture versus that;

FIG. 14*c* is a graph similar to FIG. 14*a*, but showing the maximum cutting force of each sintered alloy versus that;

FIG. 15 is a graph similar to FIG. 1, but showing those under the use of leaded gasoline versus that;

DESCRIPTION OF THE PREFERRED EMBODIMENTS

Figure 1:
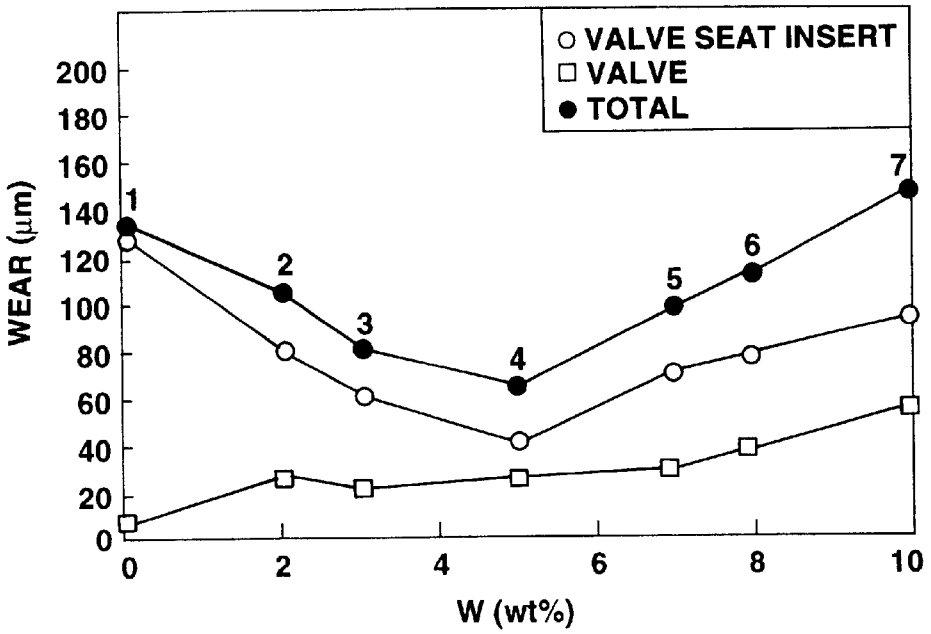
FIG. 1 is a graph showing the wears of valve seat insert, valve and their total, under the use of unleaded gasoline, versus the tungsten content of the first phase of each sintered alloy.

According to each of the above-mentioned first, second, fifth and sixth aspects of the present invention, the sintered alloy may contain 0.3–1.6 wt % of MnS that is distributed in a boundary between first grains of the first phase and second grains of the second phase and/or in pores of the sintered alloy. Due to the inclusion of this MnS, the sintered alloy can be substantially improved in machinability.

According to each of the above-mentioned first to ninth aspects of the present invention, the sintered alloy may contain a first metal that is one of metallic copper and a copper alloy. This first metal may be contained in the sintered alloy in a manner that the first metal is incorporated into the sintered alloy by infiltrating pores of the sintered alloy with a first melt of the first metal. Thus, according to the first, second, fifth and sixth aspects of the present invention, the sintered alloy may contain both of the first metal and 0.3–1.6 wt % of the MnS. According to each of the above-mentioned first to ninth aspects of the present invention, the sintered alloy may contain a second metal that is one of metallic lead and a lead alloy. The second metal may be contained in the sintered alloy in a manner to impregnate pores of the sintered alloy with the melted second metal. Thus, according to the first, second, fifth and sixth aspects of the present invention, the sintered alloy may contain both of the second metal and 0.3–1.6 wt % of the MnS. According to each of the above-mentioned first to ninth aspects of the present invention, the sintered alloy may contain an acrylic resin that is incorporated thereinto in a manner that is the same as that of the second metals. Thus, according to the first, second, fifth and sixth aspects of the present invention, the sintered alloy may contain both of the acrylic resin and 0.3–1.6 wt % of the MnS. Due to the inclusion of the first or second metal as above, the sintered alloy can be far superior in wear resistance. Due to the inclusion of the second metal or acrylic resin as above, the sintered alloy can be further improved in machinability.

According to each of the fifth to eighth aspects of the present invention, the silicon content of each of the total of the sintered alloy and its first and second phases is adjusted to a range of from 0.6 to 5.0 wt %. According to each of the second, fourth, sixth and eighth aspects of the present invention, the vanadium content of the first phase of the sintered alloy is adjusted to a range of from 0.5 to 1.5 wt %. With these adjustments, the sintered alloy of each of the second and the fourth to eighth aspects of the present invention can be further improved in wear resistance even under a condition that this sintered alloy is used, for example, as a valve seat insert of an internal combustion engine running with leaded gasoline. By the above adjustment of the silicon content, the sintered alloys according to the fifth and seventh aspects of the present invention are respectively more improved in corrosion resistance, as compared with the sintered alloy according to the first aspect of the present invention, although these sintered alloys and the powder mixtures for preparing the same respectively become lower, in hardness and compressibility, than the sintered alloy of the first aspect of the present invention and than the powder mixture for preparing the same. By the above adjustment of the silicon content, the sintered alloys according to the sixth and eighth aspects of the present invention are also respectively more improved in corrosion resistance, as compared with the sintered alloy according to the second aspect of the present invention, although these sintered alloys and the powder mixtures for preparing the same respectively become lower, in hardness and compressibility, than the sintered alloy of the second aspect of the present invention and than the powder mixture for preparing the same. Thus, as stated above, the sintered alloy according to each of the fifth to eighth aspects of the present invention becomes superior in wear resistance under the above condition in which leaded gasoline is used. According to each of the fifth to eighth aspects of the present invention, if the silicon content is greater than 5.0 wt %, the sintered alloy becomes low in hardness. Furthermore, the powder mixture for preparing sintered alloy becomes substantially low in compressibility. If the silicon content is lower than 0.6 wt %, the sintered alloy does not sufficiently improved in corrosion resistance. According to each of the second, fourth, sixth and eighth aspects of the present invention, if the vanadium content of the first phase is lower than 0.5 wt %, the sintered alloy becomes low in wear resistance, due to the insufficient corrosion resistance. If it is higher than 1.5 wt %, the sintered alloy used as the valve seat insert becomes strong in the property of damaging the valve.

According to the third, fourth, seventh and eighth aspects of the present invention, the manganese and sulfur contents of each of the total of the sintered alloy and its first and second phases are respectively adjusted to a range of from 0.2 to 1.0 wt % and a range of from 0.1 to 0.6 wt %. With these adjustments, MnS precipitates in the first and second phases of the corresponding sintered alloys. Therefore, the sintered alloy can be substantially improved in machinability. If the manganese and sulfur contents are respectively higher than 1.0 wt % and 0.6 wt %, the powder mixture for preparing the sintered alloy becomes low in compressibility. With this, the sintered alloy becomes low in hardness. If the manganese and sulfur contents are respectively lower than 0.2 wt % and 0.1 wt %, MnS does not precipitate in a sufficient amount. Therefore, the sintered alloy does not sufficiently improved in machinability.

As compared with conventional sintered alloys containing large amounts of cobalt, the sintered alloy according to the present invention can be much more economically produced and is substantially improved in wear resistance.

According to each of the first to eighth aspects of the present invention, the first and second phases of the sintered alloy may respectively have first and second grains each of which has an average particle diameter of from 20 to 150 $\mu$m.

According to the first aspect of the present invention, the sintered alloy may have a first phase that is $M_6C$-type tungsten carbide dispersed in the sintered alloy, and a second phase which is from 20 to 150 $\mu$m in average particle diameter, is reinforced with chromium, and is made of $M_6C$-type tungsten carbide and MC-type vanadium carbide that are uniformly dispersed therein. With these first and second phases, when the sintered alloy is used as a valve seat insert of an internal combustion engine, it can be sufficiently weak in the property of damaging the valve.

In the present invention, if the tungsten content of the first phase of the sintered alloy is greater than 7 wt %, the sintered alloy used as the valve seat insert becomes strong in the property of damaging the valve. If the tungsten content thereof is less than 3 wt %, the sintered alloy used as the valve seat insert becomes inferior in wear resistance. As the chromium content of the first phase of the sintered alloy increases, the sintered alloy used as the valve seat insert becomes stronger in the property of damaging the valve. Thus, chromium may be omitted in the first phase of the sintered alloy, but the first phase may contain up to 1 wt % of chromium generated by the diffusion from the second phase into the first phase, at the time of sintering.

In the present invention, if the tungsten and vanadium contents of the second phase of the sintered alloy are respectively greater than 15 wt % and 7 wt %, the sintered alloy used as the valve seat insert becomes strong in the property of damaging the valve. If they are respectively lower than 3 wt % and 2 wt %, it becomes inferior in wear resistance. Due to the inclusion of 1–7 wt % of chromium in the second phase of the sintered alloy, the sintered alloy becomes improved in harden ability. Furthermore, the MC-type vanadium carbide deposits in the second phase, and thus the second phase becomes harder than the first phase. Therefore, the sintered alloy becomes uneven in hardness and thus becomes superior in wear resistance. If the chromium content of the second phase is greater than 7 wt %, the sintered alloy used as the valve seat insert becomes strong in the property of damaging the valve. If it is lower than 1 wt %, it becomes inferior in wear resistance.

According to the first to fourth aspects of the present invention, the silicon content of each of the total of the sintered alloy and its first and second phases is adjusted to a range of from 0.1 to 0.6 wt %, as mentioned above. If it is greater than 0.6 wt %, the sintered alloy becomes low in hardness. If it is lower than 0.1 wt %, it becomes low in hardness, too, due to the inferior sinterability.

According to the first, second, fifth and sixth aspects of the present invention, the manganese content of each of the total of the sintered alloy and its first and second phases is adjusted to a range of from 0.1 to 0.6 wt %, as mentioned above. Due to this adjustment, the sintered alloy becomes high in hardness. If it is greater than 0.6 wt %, it becomes low in hardness, due to the inferior sinterability.

In the invention, the weight ratio of the second phase to the first phase in the sintered alloy is in a range of from 20:100 to 80:100. If it is lower than 20:100, the sintered alloy used as the valve seat insert becomes low in wear resistance. If it is greater than 80:100, it becomes strong in the property of damaging the valve.

According to the second aspect of the present invention, the vanadium content of the first phase of the sintered alloy is adjusted to a range of from 0.5 to 1.5 wt %. With this, the sintered alloy is further improved in corrosion resistance, and thus is superior in wear resistance under the use of leaded gasoline. If it is less than 0.5 wt %, the sintered alloy becomes low in wear resistance, due to insufficient corrosion resistance. If it is greater than 1.5 wt %, the sintered alloy used as the valve seat insert becomes strong in the property of damaging the valve.

As stated above, according to each of the fifth to eighth aspects of the present invention, the silicon content of each of the total of the sintered alloy and its first and second phases is adjusted to a range of from 0.6 to 5.0 wt %.

The following nonlimitative example is illustrative of the present invention.

EXAMPLE

At first, powders (G1–G113), each having an average particle diameter of from 20 to 150 $\mu$m and a chemical composition as shown in Table 1, were prepared. Then, as shown in Table 2, each powder mixture was prepared by blending a powder for preparing the first phase, another powder for preparing the second phase, a graphite powder, and zinc stearate used as a lubricant, for 30 min, using a mixer. Then, each powder mixture was subjected to a pressure of 6.5 ton f/cm$^2$, thereby to prepare a powder compact having an inner diameter of 20 mm, an outer diameter of 40 mm, and a thickness of 10 mm. After that, the powder compacts were sintered in an atmosphere of a destructive ammonia gas at 1180° C. for 30 min, thereby to obtain sintered alloys having sample numbers of from 1 to 138 and chemical compositions as shown in Tables 3a–3m.

As shown in Table 6, each of the sintered alloys of sample nos. 4, 22, 58, 124, 46, 112, 63 and 129 was infiltrated with melted copper by putting a copper powder compact on each sintered alloy, then by keeping it in an atmosphere of a destructive ammonia gas at 1140° C. for 30 min. Furthermore, each of these sintered alloys was impregnated with lead by immersing in a vacuum each sintered alloy into a lead melt heated at 550° C., followed by a pressurization to 8 atmospheric pressure through an enclosure of nitrogen gas. Still furthermore, each of these sintered alloys was impregnated with an acrylic resin by a vacuum impregnation method, followed by curing in hot water heated at 100° C. In Table 6, for example, sample nos. of 4, 4-Cu, 4-Pb, and 4-Resin respectively represent a sintered alloy of No. 4 with no impregnation, a sintered alloy of No. 4 impregnated with copper, that impregnated with lead, and that impregnated with an acrylic resin.

EVALUATION TESTS

A wear resistance test on the sintered alloys was conducted, as follows, in order to evaluate wear resistance of each sintered alloy. At first, the sintered alloys were formed into a shape of a valve seat insert of an internal combustion engine. In this test, each valve seat insert was installed on an exhaust port side of an internal combustion engine having in-line four cylinders with 16 valves and a displacement of 1,600 cc. These valves were made of SUH-36, and their valve faces were coated with stellite #32. The wear resistance test was conducted by operating the engine for 300 hr, with an engine rotation speed of 6,000 rpm, using an unleaded regular gasoline or a leaded gasoline. After the test, there was measured wear of each valve seat insert of the invention and of the corresponding valve.

A machinability test on the sintered alloys was conducted, as follows. In this test, outer surfaces of 50 pieces of each sintered alloy having an outer diameter of 40 mm and a thickness of 10 mm were cut by an Ohkuma-type lathe, with a rotation speed of 525 rpm, a machining stock of 0.5 mm, a running speed of 0.1 mm per revolution, and a super hard chip, without using any cutting oil. In this test, the maximum cutting force of the lathe was recorded as the result.

Radial crushing strength of each sintered alloy having an outer diameter of 40 mm, an inner diameter of 20 mm, and a thickness of 10 mm was determined with an autograph under a condition of a cross head speed of 0.5 mm/min.

The evaluation of compressibility of each powder mixture was conducted as follows. At first, each powder mixture was compacted under a load of 6 ton f, with an Amsler type testing machine, using a mold having a diameter of 11.3 mm. Then, the density of the powder compact was determined.

In each of FIGS. 1–26*c*, the numerals added in the graph represent the sample numbers of the sintered alloys.

Figure 2:
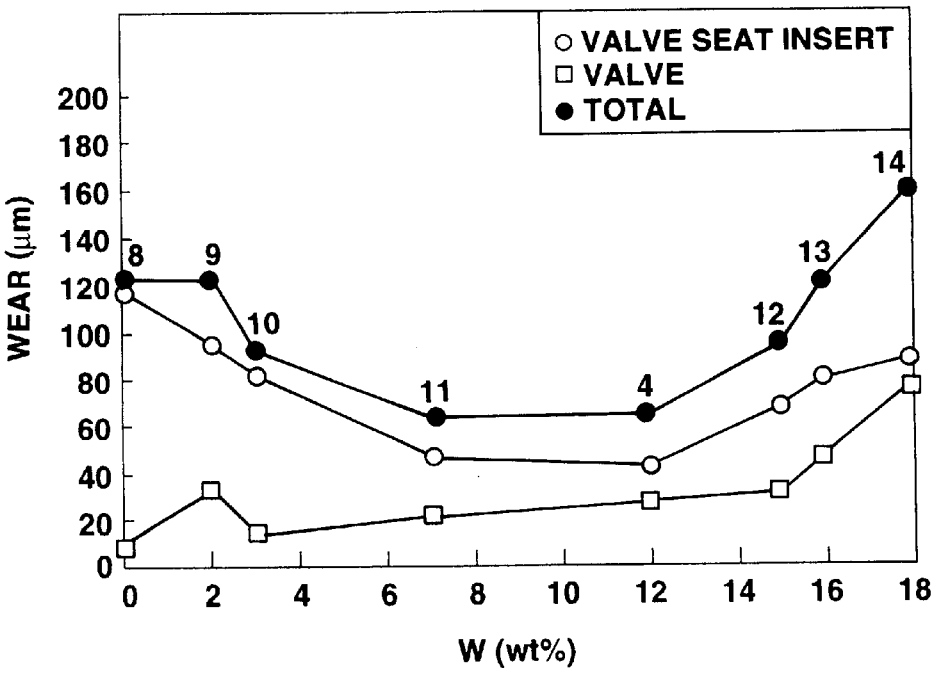
FIG. 2 is a graph similar to FIG. 1, but showing those versus that of the second phase thereof.
Figure 3:
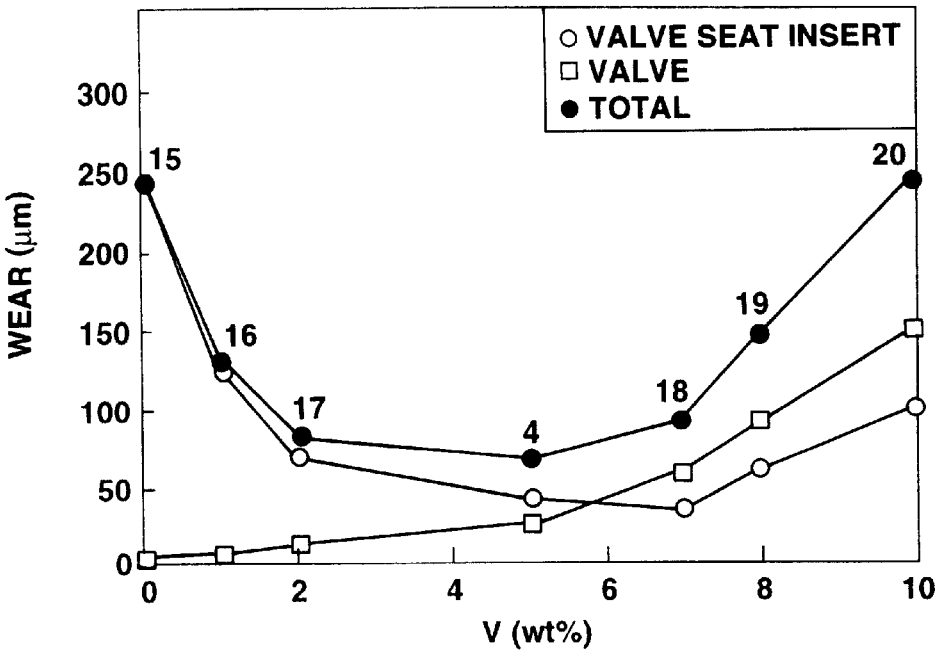
FIG. 3 is a graph similar to FIG. 1, but showing those versus the vanadium content of the second phase thereof.
Figure 4:
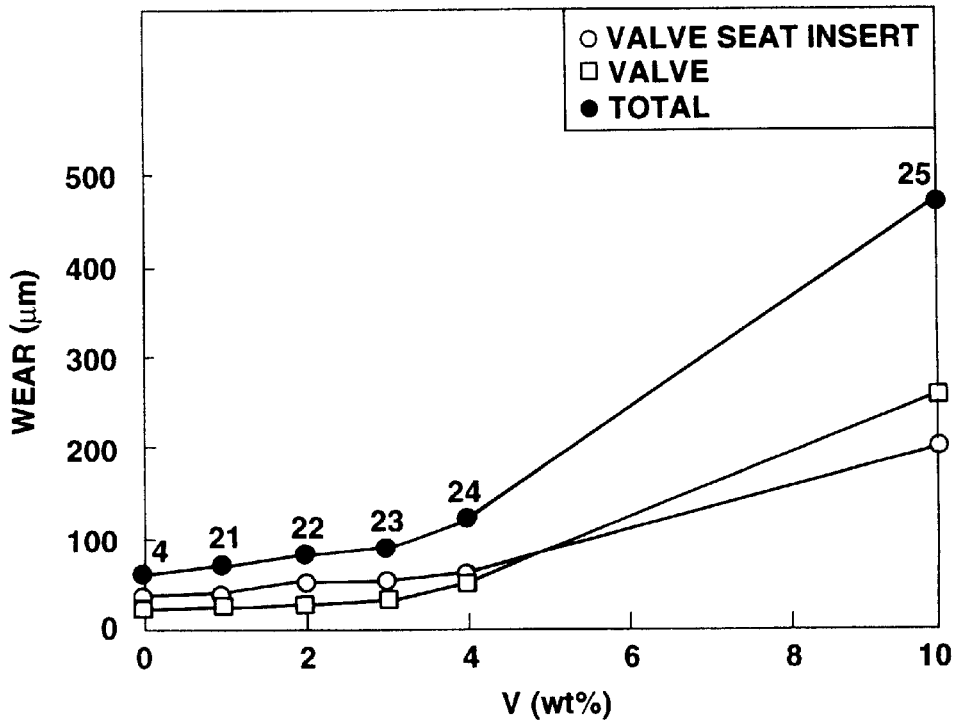
FIG. 4 is a graph similar to FIG. 3, but showing those versus that of the first phase thereof.
Figure 5:
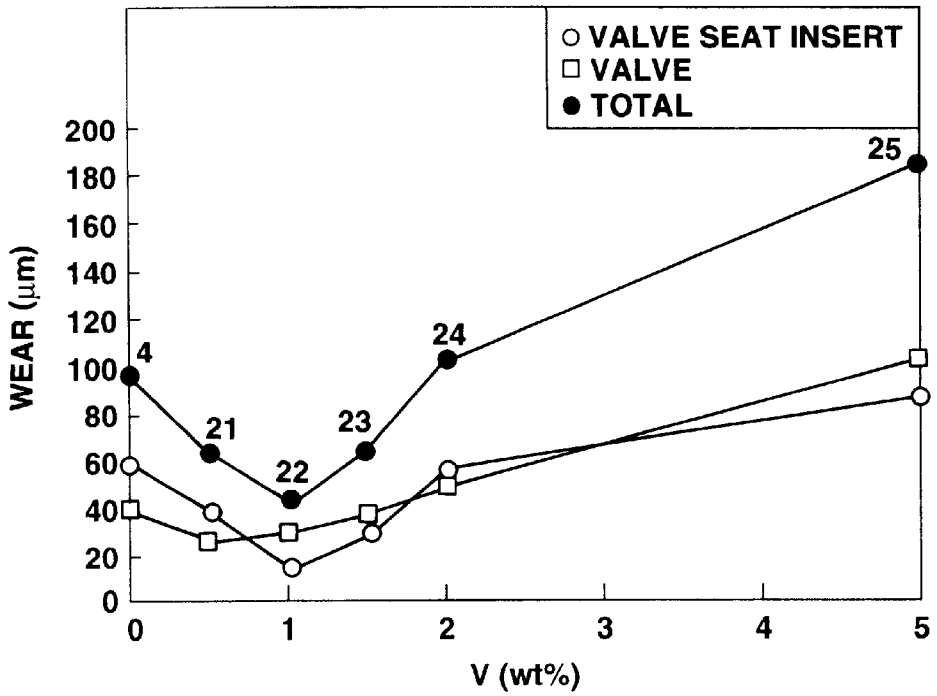
FIG. 5 is a graph similar to FIG. 4, but showing the wears thereof under the use of leaded gasoline versus that of the first phase thereof.
Figure 6:
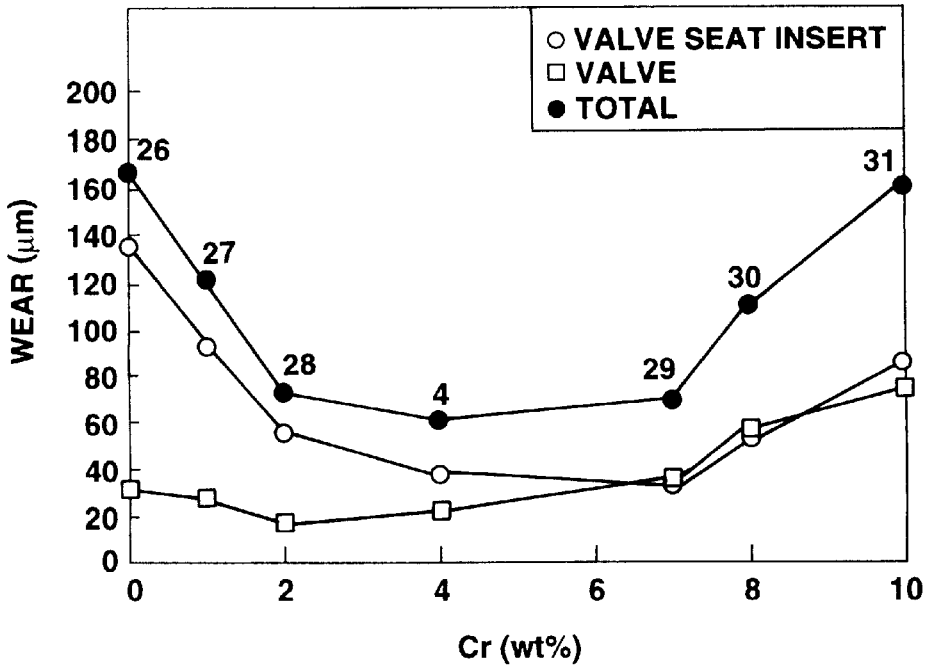
FIG. 6 is a graph similar to FIG. 1, but showing those versus the chromium content of the second phase thereof.
Figure 7:
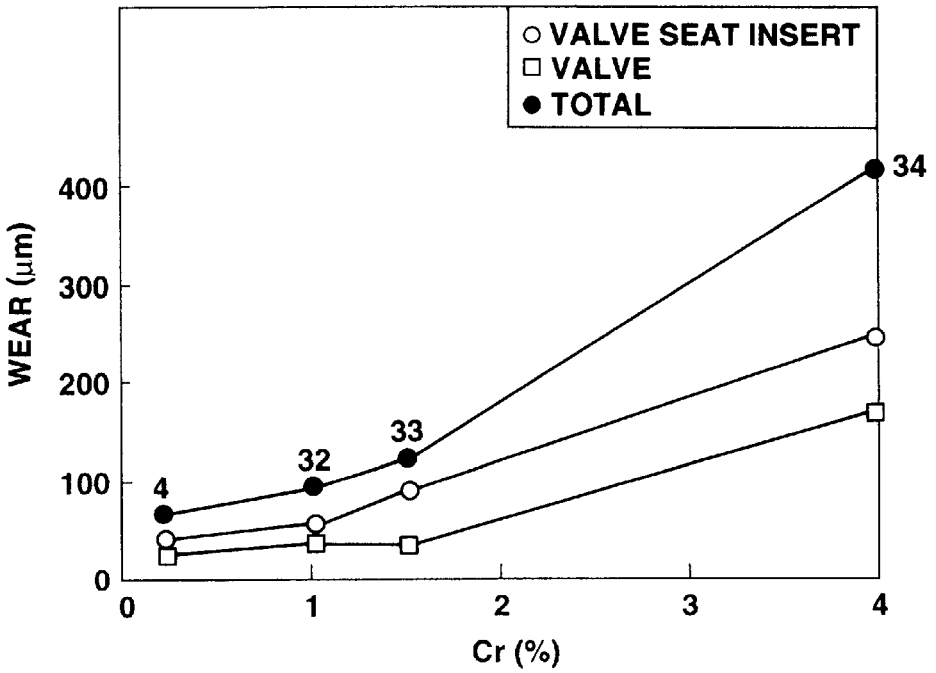
FIG. 7 is a graph similar to FIG. 7, but showing those versus that of the first phase thereof.
Figure 8:
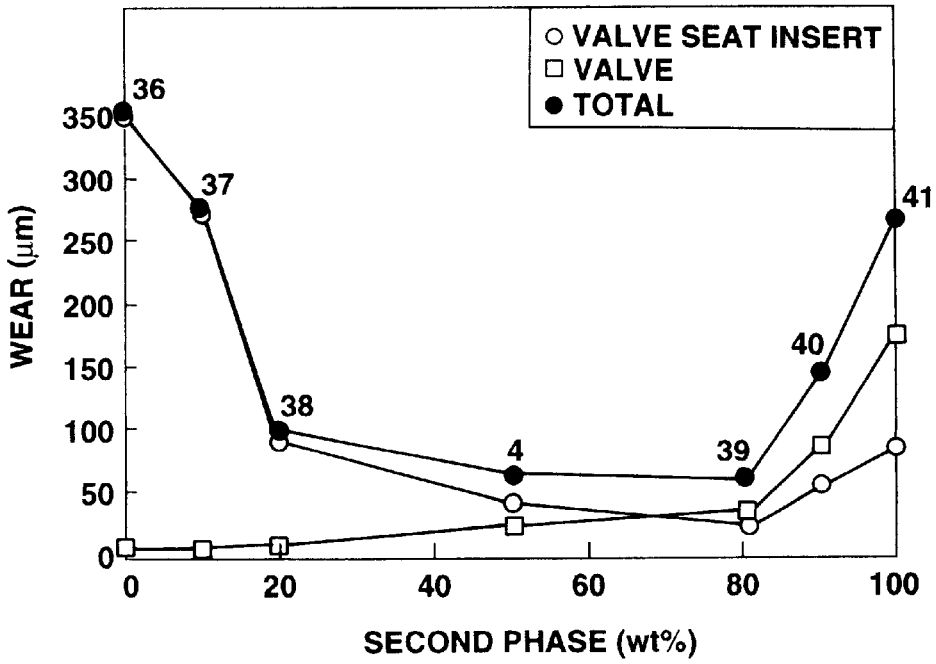
FIG. 8 is a graph similar to FIG. 1, but showing those versus the weight percent of the second phase, based on the total weight of the first and second phases.
Figure 9:
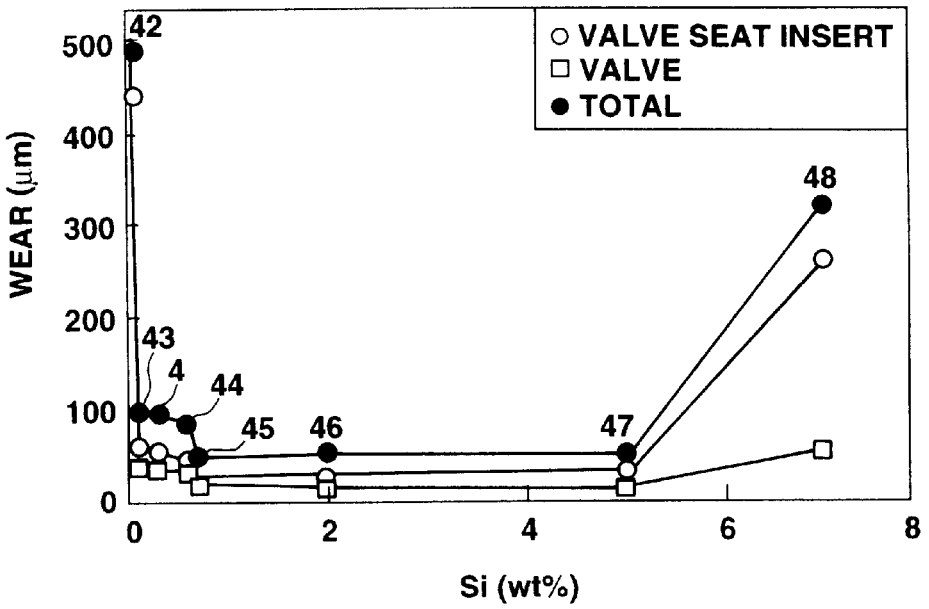
FIG. 9 is a graph similar to FIG. 1, but showing those under the use of leaded gasoline versus the silicon content of the first or second phase thereof.
Figure 10:
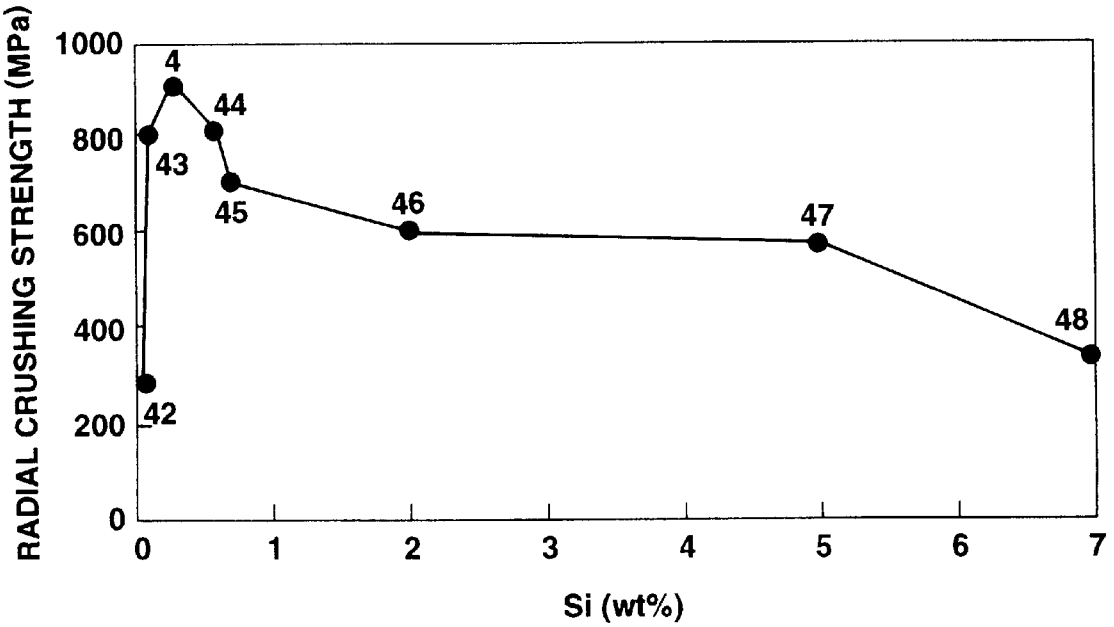
Figure 11:
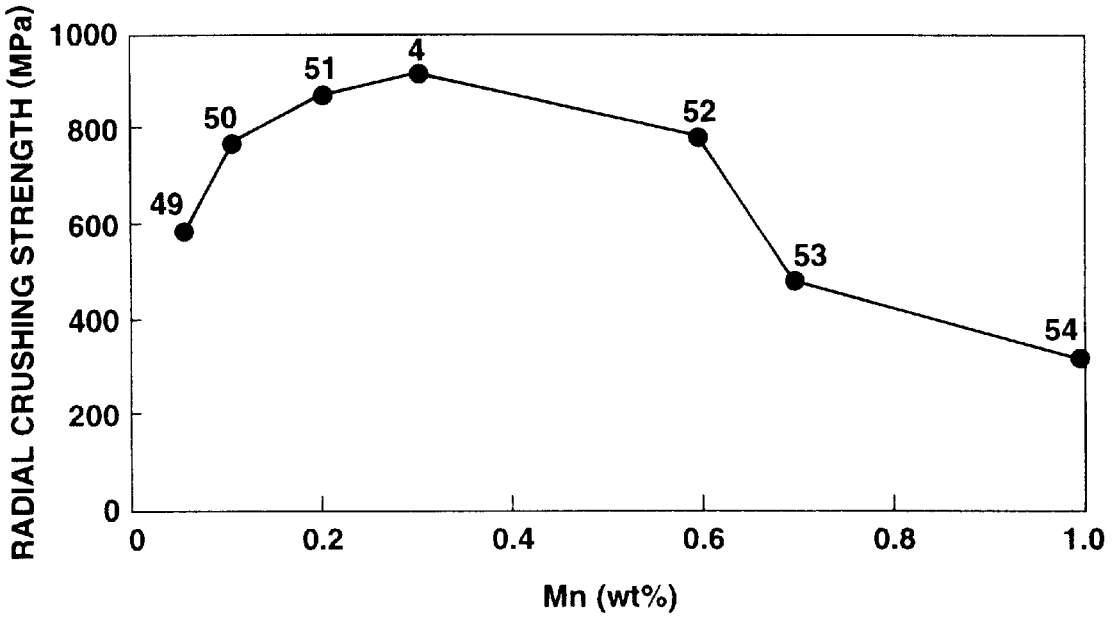
FIG. 11 is a graph similar to FIG. 10, but showing that versus the manganese content of the first or second phase thereof.
Figure 12:
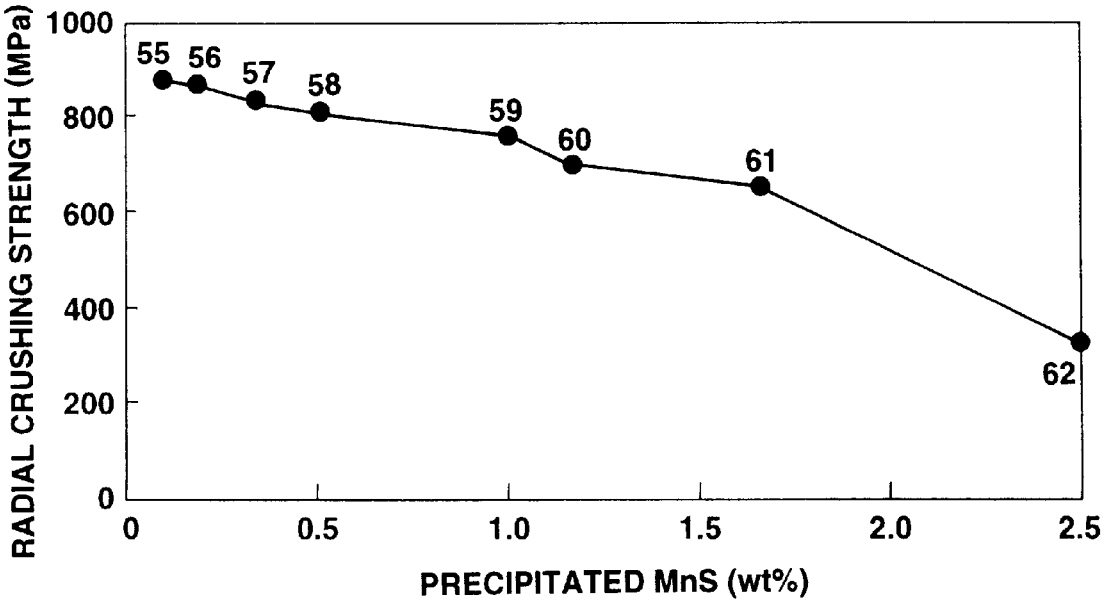
FIG. 12 is a graph similar to FIG. 10, but showing that versus the precipitated MnS content of the first or second phase thereof.
Figure 13:
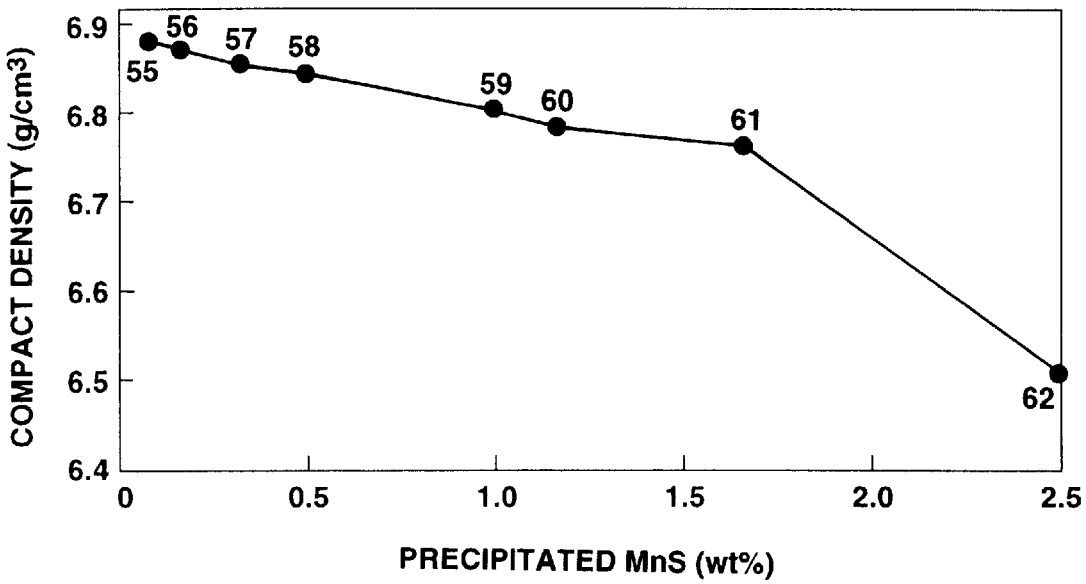
Figure 14:
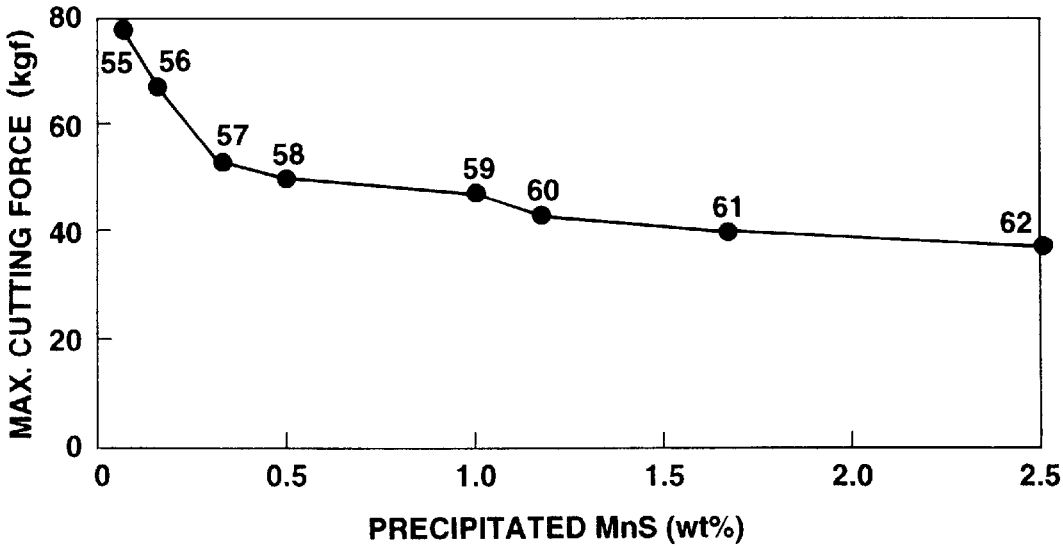
Figure 14A:
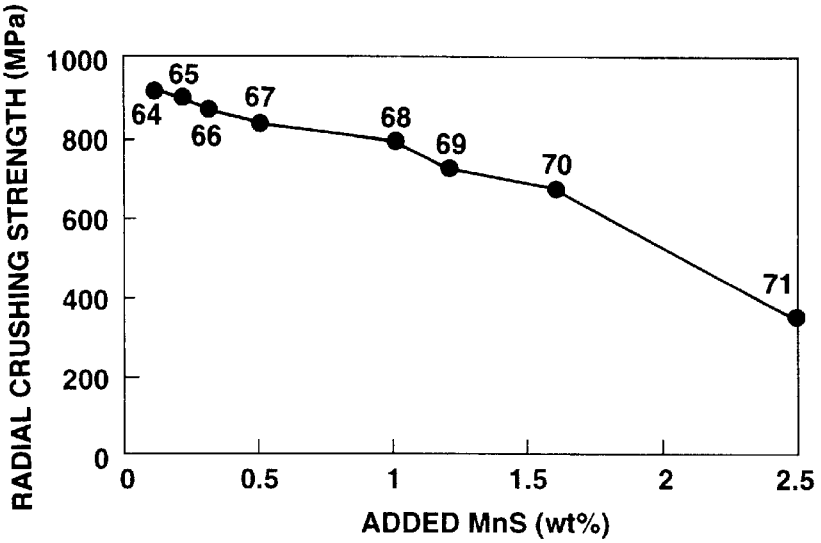
FIG. 14*a* is a graph similar to FIG. 10, but showing that versus the added MnS content of the first or second phase thereof.
Figure 14B:
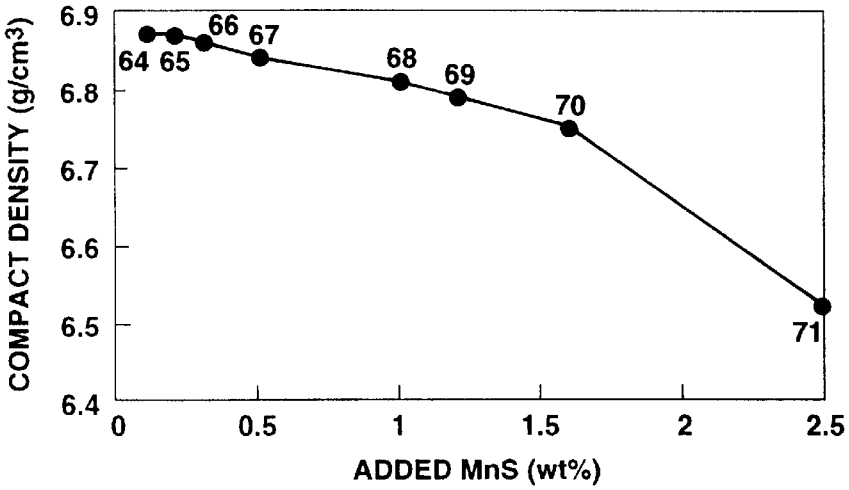
Figure 14C:
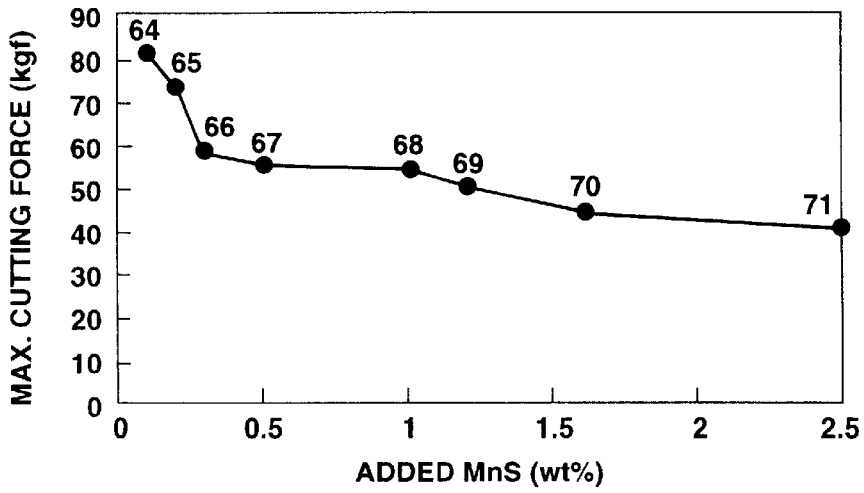
Figure 15:
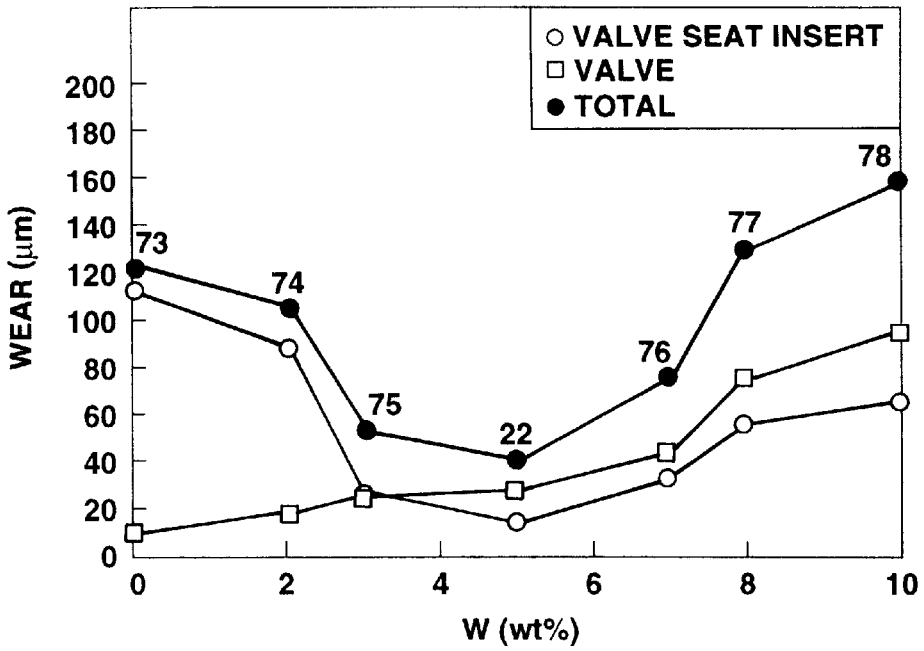
Figure 16:
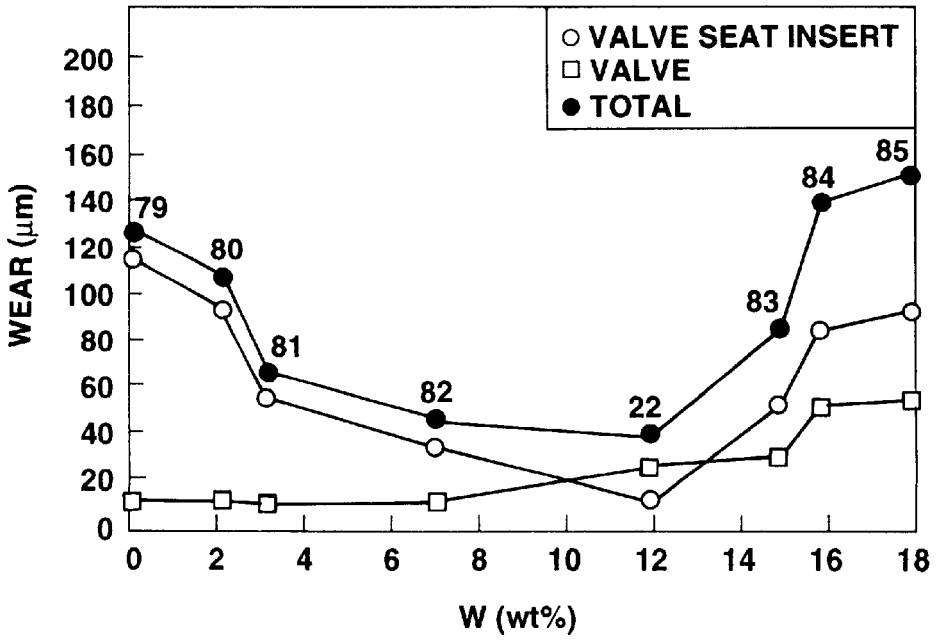
FIG. 16 is a graph similar to FIG. 15, but showing those versus the tungsten content of the second phase thereof.
Figure 17:
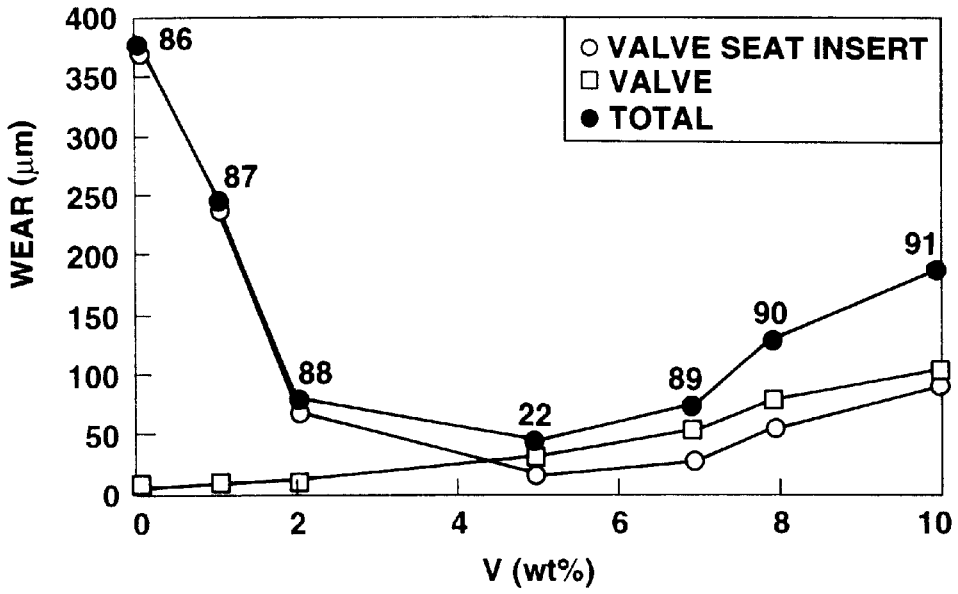
FIG. 17 is a graph similar to FIG. 15, but showing those versus the vanadium content of the second phase thereof.
Figure 18:
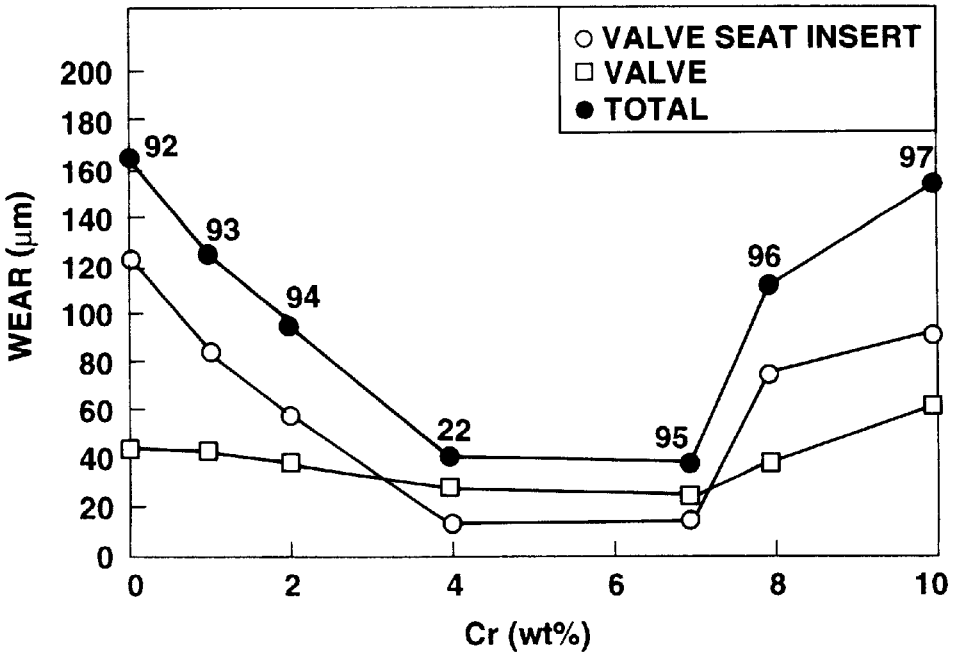
FIG. 18 is a graph similar to FIG. 15, but showing those versus the chromium content of the second phase thereof.
Figure 19:
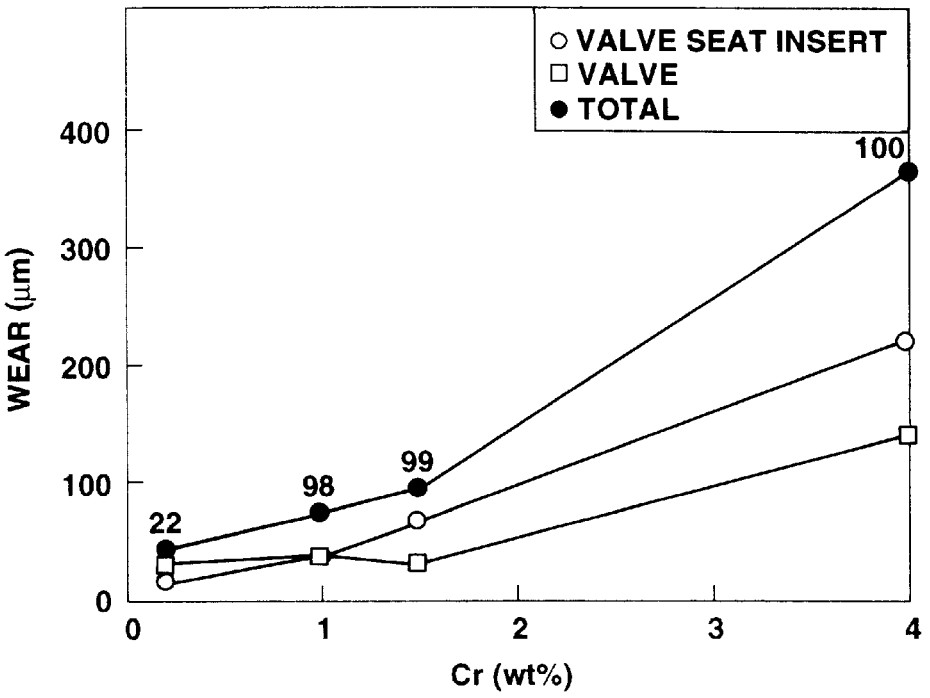
FIG. 19 is a graph similar to FIG. 15, but showing those versus the chromium content of the first phase thereof.
Figure 20:
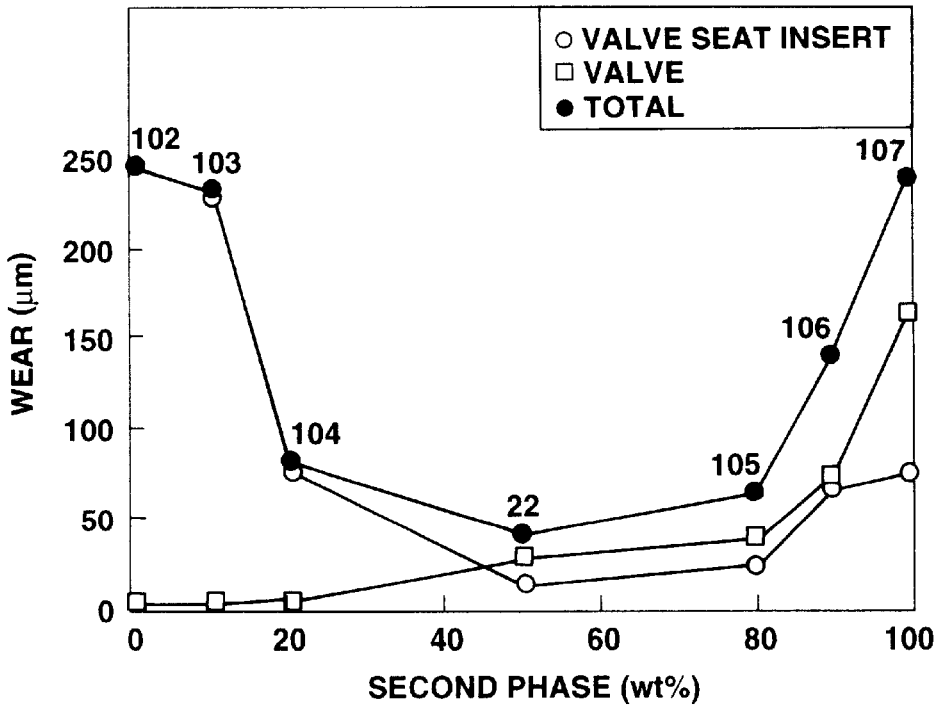
FIG. 20 is a graph similar to FIG. 15, but showing those versus the weight percent of the second phase, based on the total weight of the first and second phases.
Figure 21:
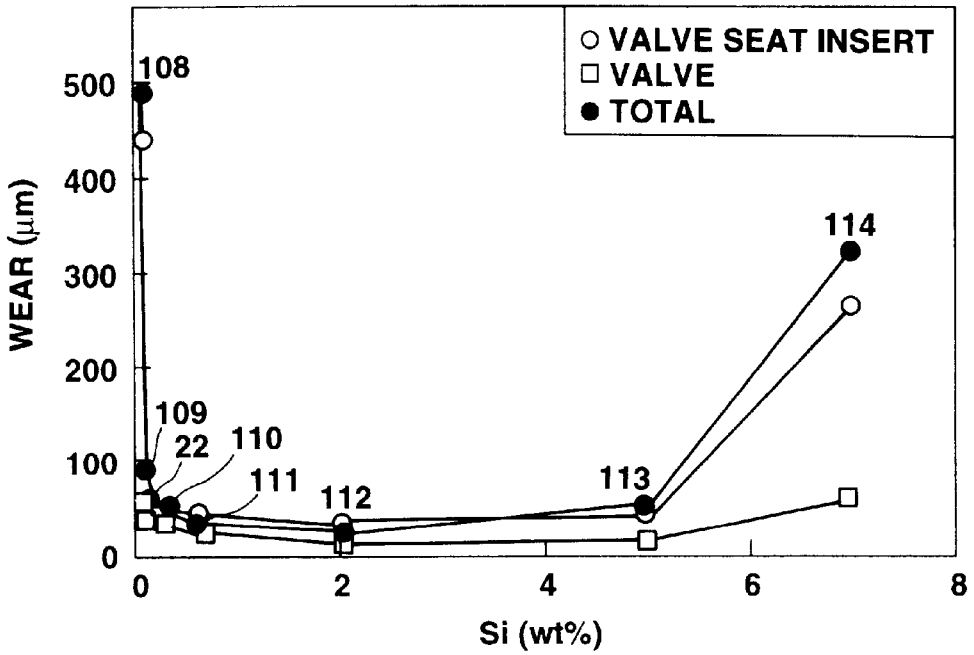
FIG. 21 is a graph similar to FIG. 15, but showing those versus the silicon content of the first or second phase thereof.
Figure 22:
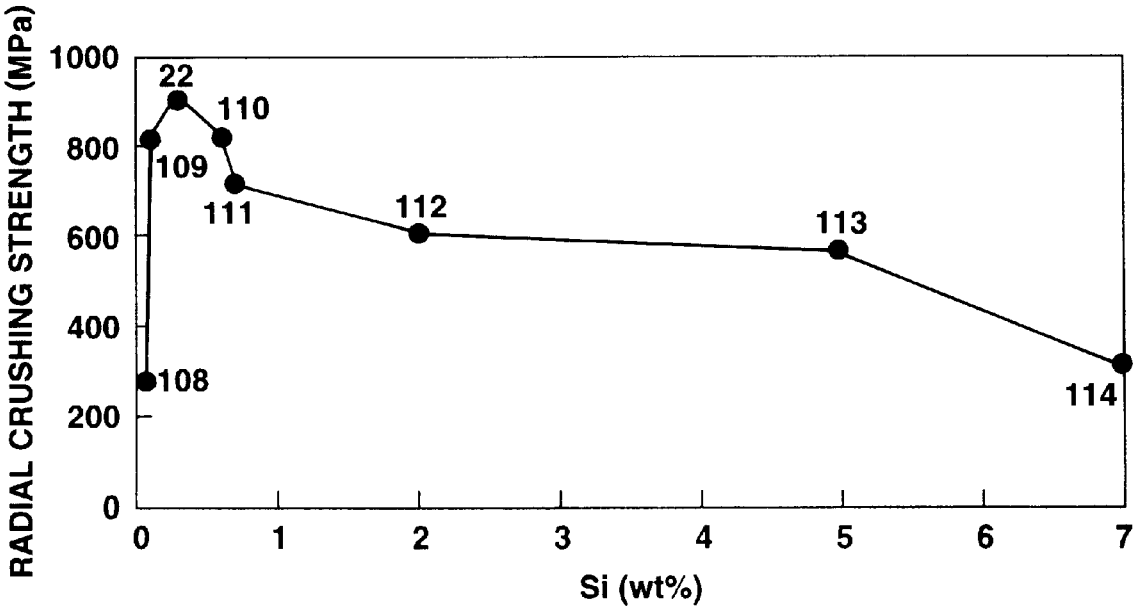
FIGS. 22–26 are graphs respectively similar to FIGS. 10–14, but showing the data of other samples of the sintered alloys.
Figure 23:
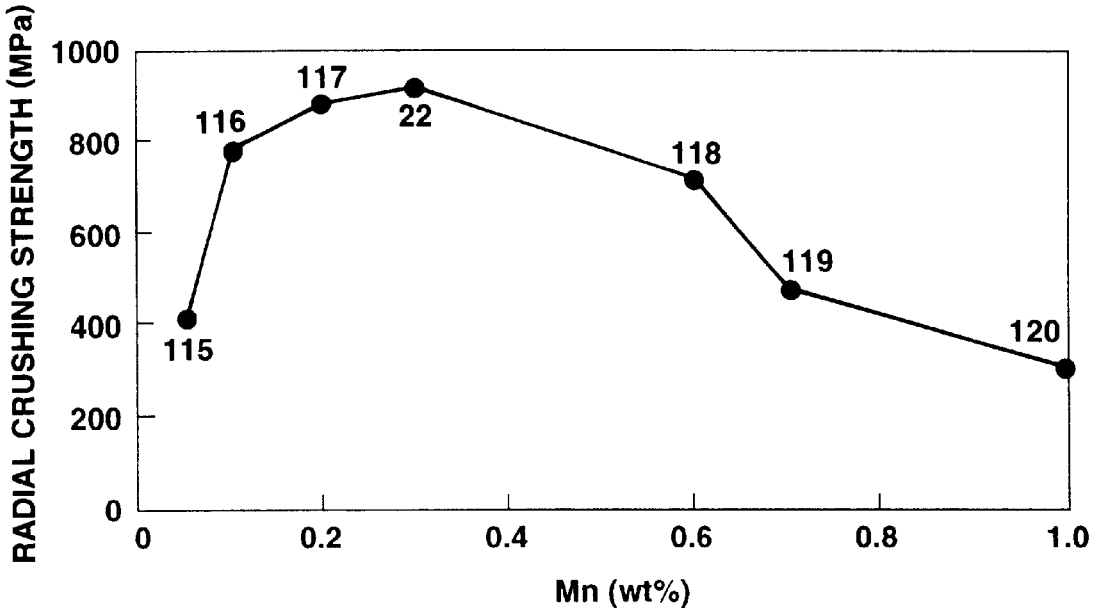
Figure 24:
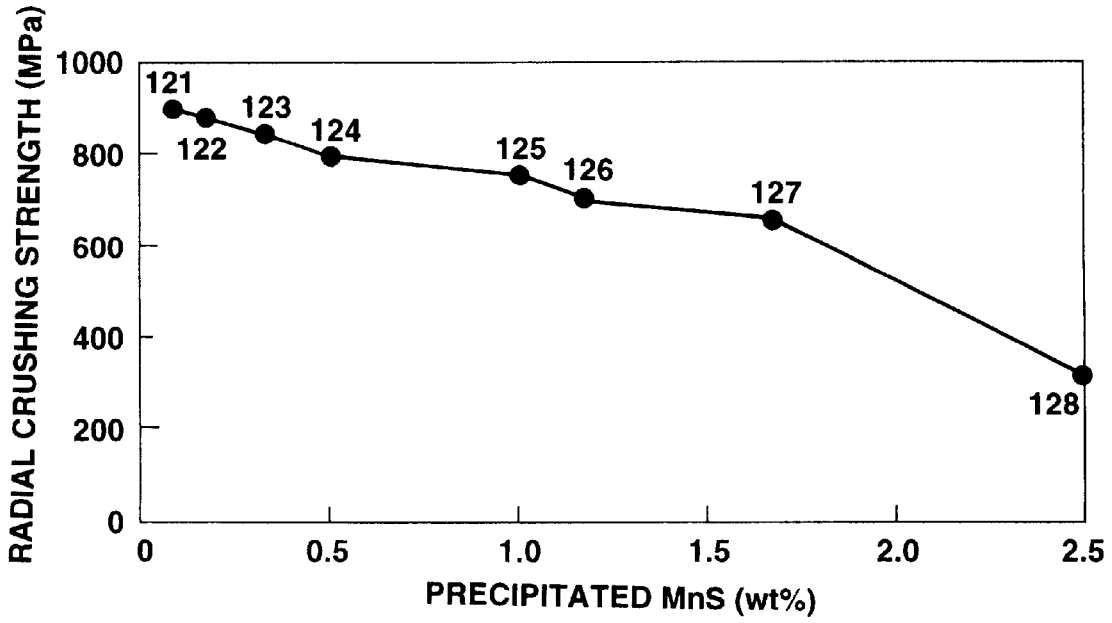
Figure 25:
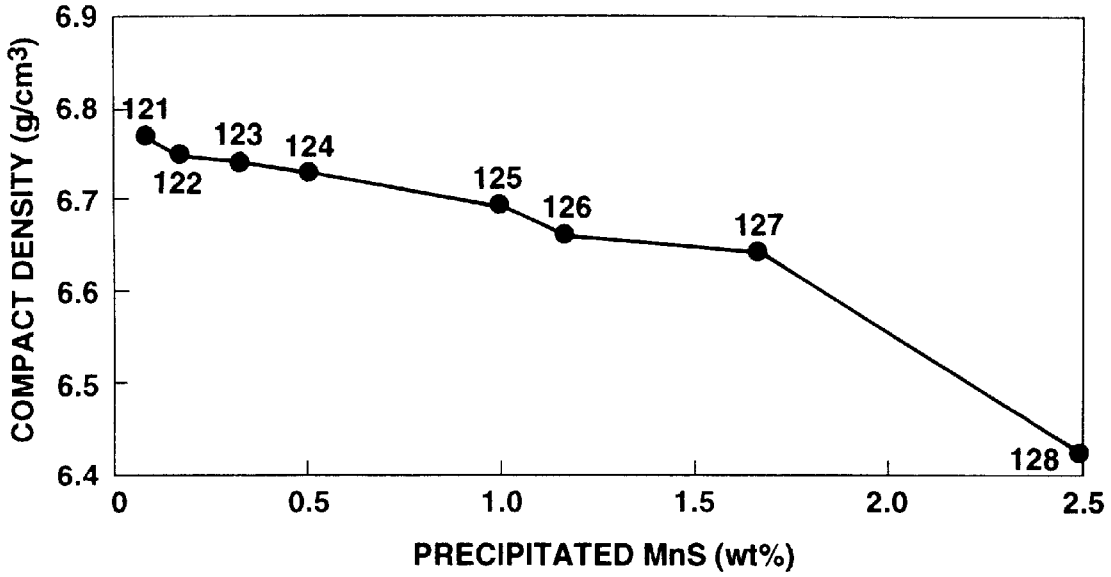
Figure 26:
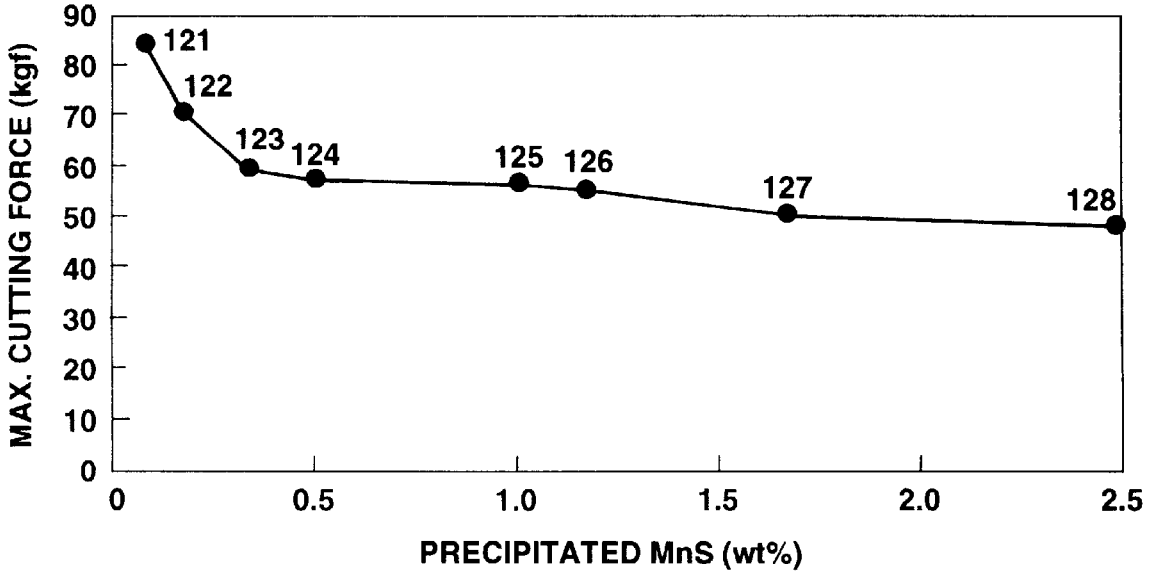
Figure 26A:
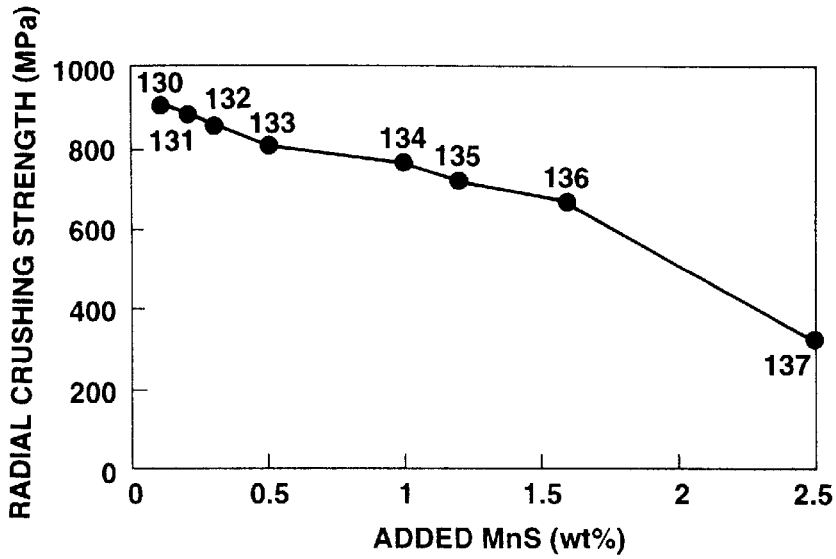
FIGS. 26*a*–26*c* are graphs respectively similar to FIGS. 14*a*–14*c*, but showing the data of other samples of the sintered alloys.
Figure 26B:
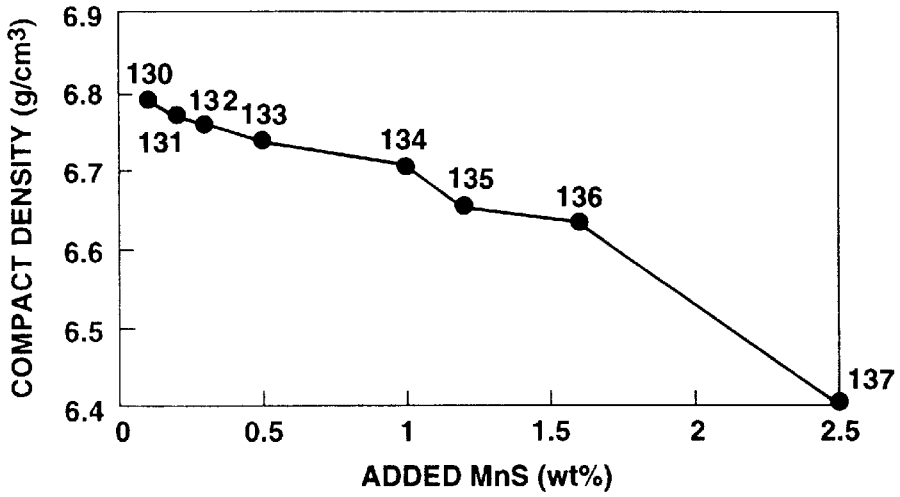
Figure 26C:
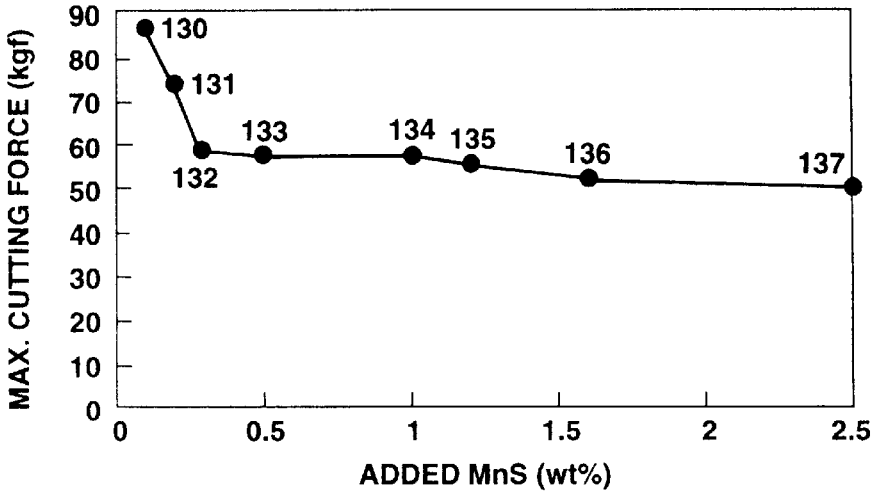

The results of the above tests were interpreted as follows. As shown in FIG. 1 and the corresponding upper half of Table 4a, it was interpreted that the wear under the use of unleaded gasoline becomes sufficiently low by adjusting the tungsten content of the first phase to a range of from 3 to 7 wt %. Furthermore, as shown in FIG. 15 and the corresponding upper half of Table 4e, it was also interpreted that the wear under the use of leaded gasoline becomes sufficiently low by adjusting the tungsten content of the first phase to a range of from 3 to 7 wt %. As shown in FIG. 2 and the corresponding lower half of Table 4a, it was interpreted that the wear under the use of unleaded gasoline becomes sufficiently low by adjusting the tungsten content of the second phase to a range of from 3 to 15 wt %. Furthermore, as shown in FIG. 16 and the corresponding lower half of Table 4e, it was also interpreted that the wear under the use of leaded gasoline becomes sufficiently low by adjusting the tungsten content of the second phase to a range of from 3 to 15 wt %. As shown in FIG. 3 and the corresponding upper half of Table 4b, it was interpreted that the wear under the use of unleaded gasoline becomes sufficiently low by adjusting the vanadium content of the second phase to a range of from 2 to 7 wt %. Furthermore, as shown in FIG. 17 and the corresponding upper half of Table 4f, it was interpreted that the wear under the use of leaded gasoline becomes sufficiently low by adjusting the vanadium content of the second phase to a range of from 2 to 7 wt %. As shown in FIGS. 4 and 5 and the corresponding lower half of Table 4b, it was interpreted that the wear under the uses of unleaded and leaded gasolines becomes sufficiently low by adjusting the vanadium content of the first phase to a range of up to 1.5 wt %. As shown in FIG. 6 and the corresponding upper half of Table 4c, it was interpreted that the wear under the use of unleaded gasoline becomes sufficiently low by adjusting the chromium content of the second phase to a range of from 1 to 7 wt %. Furthermore, as shown in FIG. 18 and the corresponding lower half of Table 4f, it was interpreted that the wear under the use of leaded gasoline becomes sufficiently low by adjusting the chromium content of the second phase to a range of from 1 to 7 wt %. As shown in FIG. 7 and the corresponding lower half of Table 4c, it was interpreted that the wear under the use of unleaded gasoline becomes sufficiently low by adjusting the chromium content of the first phase to a range of up to 1 wt %. Furthermore, as shown in FIG. 19 and the corresponding upper half of Table 4g, it was interpreted that the wear under the use of leaded gasoline becomes sufficiently low by adjusting the chromium content of the first phase to a range of up to 1 wt %. As shown in FIG. 8 and the corresponding upper half of Table 4d, it was interpreted that the wear under the use of unleaded gasoline becomes sufficiently low by adjusting the weight ratio of the first phase to the second phase to a range of from 20:80 to 80:20. Furthermore, as shown in FIG. 20 and the corresponding lower half of Table 4g, it was also interpreted that the wear under the use of leaded gasoline becomes sufficiently low by adjusting the weight ratio of the first phase to the second phase to a range of from 20:80 to 80:20. As shown in FIGS. 9–10 and the corresponding upper half of Table 5a and FIGS. 21–22 and the corresponding upper half of Table 5d, it was interpreted that the wear resistance under the use of leaded gasoline and the radial crushing strength become sufficiently high by adjusting the silicon content of the first or second phase to a range of from 0.1 to 5.0 wt %. As shown in FIG. 11 and the corresponding lower half of Table 5a and FIG. 23 and the corresponding lower half of Table 5d, it was interpreted that the radial crushing strength becomes sufficiently high by adjusting the manganese content of the first or second phase to a range of from 0.1 to 0.6 wt %.

TABLE 1

| Powder | Powder Composition (wt %) | | | | | | | | |
|---|---|---|---|---|---|---|---|---|---|
| No. | Fe | W | V | Cr | Si | Mn | S | C | O |
| G1 | Balance | 0 | 0 | 0 | 0.3 | 0.3 | 0 | 0.6 | 0.3 |
| G2 | Balance | 2 | 0 | 0 | 0.3 | 0.3 | 0 | 0.6 | 0.3 |
| G3 | Balance | 3 | 0 | 0 | 0.3 | 0.3 | 0 | 0.6 | 0.3 |
| G4 | Balance | 5 | 0 | 0 | 0.3 | 0.3 | 0 | 0.6 | 0.3 |
| G5 | Balance | 7 | 0 | 0 | 0.3 | 0.3 | 0 | 0.6 | 0.3 |
| G6 | Balance | 8 | 0 | 0 | 0.3 | 0.3 | 0 | 0.6 | 0.3 |
| G7 | Balance | 10 | 0 | 0 | 0.3 | 0.3 | 0 | 0.6 | 0.3 |
| G8 | Balance | 5 | 0.5 | 0 | 0.3 | 0.3 | 0 | 0.6 | 0.3 |
| G9 | Balance | 5 | 1 | 0 | 0.3 | 0.3 | 0 | 0.6 | 0.3 |
| G10 | Balance | 5 | 1.5 | 0 | 0.3 | 0.3 | 0 | 0.6 | 0.3 |
| G11 | Balance | 5 | 2 | 0 | 0.3 | 0.3 | 0 | 0.6 | 0.3 |
| G12 | Balance | 5 | 5 | 0 | 0.3 | 0.3 | 0 | 0.6 | 0.3 |
| G13 | Balance | 5 | 0 | 0.9 | 0.3 | 0.3 | 0 | 0.6 | 0.3 |
| G14 | Balance | 5 | 0 | 1.4 | 0.3 | 0.3 | 0 | 0.6 | 0.3 |
| G15 | Balance | 5 | 0 | 4 | 0.3 | 0.3 | 0 | 0.6 | 0.3 |
| G16 | Balance | 5 | 0 | 0 | 0.05 | 0.3 | 0 | 0.6 | 0.3 |
| G17 | Balance | 5 | 0 | 0 | 0.1 | 0.3 | 0 | 0.6 | 0.3 |
| G18 | Balance | 5 | 0 | 0 | 0.6 | 0.3 | 0 | 0.6 | 0.3 |
| G19 | Balance | 5 | 0 | 0 | 0.7 | 0.3 | 0 | 0.6 | 0.3 |
| G20 | Balance | 5 | 0 | 0 | 2 | 0.3 | 0 | 0.6 | 0.3 |
| G21 | Balance | 5 | 0 | 0 | 5 | 0.3 | 0 | 0.6 | 0.3 |
| G22 | Balance | 5 | 0 | 0 | 7 | 0.3 | 0 | 0.6 | 0.3 |
| G23 | Balance | 5 | 0 | 0 | 0.3 | 0.05 | 0 | 0.6 | 0.3 |
| G24 | Balance | 5 | 0 | 0 | 0.3 | 0.1 | 0 | 0.6 | 0.3 |
| G25 | Balance | 5 | 0 | 0 | 0.3 | 0.2 | 0 | 0.6 | 0.3 |
| G26 | Balance | 5 | 0 | 0 | 0.3 | 0.6 | 0 | 0.6 | 0.3 |
| G27 | Balance | 5 | 0 | 0 | 0.3 | 0.7 | 0 | 0.6 | 0.3 |
| G28 | Balance | 5 | 0 | 0 | 0.3 | 1 | 0 | 0.6 | 0.3 |
| G29 | Balance | 5 | 0 | 0 | 0.3 | 0.05 | 0.03 | 0.6 | 0.3 |
| G30 | Balance | 5 | 0 | 0 | 0.3 | 0.1 | 0.07 | 0.6 | 0.3 |
| G31 | Balance | 5 | 0 | 0 | 0.3 | 0.2 | 0.13 | 0.6 | 0.3 |
| G32 | Balance | 5 | 0 | 0 | 0.3 | 0.3 | 0.2 | 0.6 | 0.3 |

TABLE 1-continued

| Powder | Powder Composition (wt %) | | | | | | | | |
|---|---|---|---|---|---|---|---|---|---|
| No. | Fe | W | V | Cr | Si | Mn | S | C | O |
| G33 | Balance | 5 | 0 | 0 | 0.3 | 0.6 | 0.4 | 0.6 | 0.3 |
| G34 | Balance | 5 | 0 | 0 | 0.3 | 0.7 | 0.47 | 0.6 | 0.3 |
| G35 | Balance | 5 | 0 | 0 | 0.3 | 1 | 0.67 | 0.6 | 0.3 |
| G36 | Balance | 5 | 0 | 0 | 0.3 | 1.5 | 1 | 0.6 | 0.3 |
| G37 | Balance | 0 | 5 | 4 | 0.3 | 0.3 | 0 | 0.6 | 0.3 |
| G38 | Balance | 2 | 5 | 4 | 0.3 | 0.3 | 0 | 0.6 | 0.3 |
| G39 | Balance | 3 | 5 | 4 | 0.3 | 0.3 | 0 | 0.6 | 0.3 |
| G40 | Balance | 7 | 5 | 4 | 0.3 | 0.3 | 0 | 0.6 | 0.3 |
| G41 | Balance | 12 | 5 | 4 | 0.3 | 0.3 | 0 | 0.6 | 0.3 |
| G42 | Balance | 15 | 5 | 4 | 0.3 | 0.3 | 0 | 0.6 | 0.3 |
| G43 | Balance | 16 | 5 | 4 | 0.3 | 0.3 | 0 | 0.6 | 0.3 |
| G44 | Balance | 18 | 5 | 4 | 0.3 | 0.3 | 0 | 0.6 | 0.3 |
| G45 | Balance | 12 | 0 | 4 | 0.3 | 0.3 | 0 | 0.6 | 0.3 |
| G46 | Balance | 12 | 1 | 4 | 0.3 | 0.3 | 0 | 0.6 | 0.3 |
| G47 | Balance | 12 | 2 | 4 | 0.3 | 0.3 | 0 | 0.6 | 0.3 |
| G48 | Balance | 12 | 7 | 4 | 0.3 | 0.3 | 0 | 0.6 | 0.3 |
| G49 | Balance | 12 | 8 | 4 | 0.3 | 0.3 | 0 | 0.6 | 0.3 |
| G50 | Balance | 12 | 10 | 4 | 0.3 | 0.3 | 0 | 0.6 | 0.3 |
| G51 | Balance | 12 | 5 | 0 | 0.3 | 0.3 | 0 | 0.6 | 0.3 |
| G52 | Balance | 12 | 5 | 1 | 0.3 | 0.3 | 0 | 0.6 | 0.3 |
| G53 | Balance | 12 | 2 | 2 | 0.3 | 0.3 | 0 | 0.6 | 0.3 |
| G54 | Balance | 12 | 7 | 7 | 0.3 | 0.3 | 0 | 0.6 | 0.3 |
| G55 | Balance | 12 | 8 | 8 | 0.3 | 0.1 | 0 | 0.6 | 0.3 |
| G56 | Balance | 12 | 10 | 10 | 0.3 | 0.2 | 0 | 0.6 | 0.3 |
| G57 | Balance | 12 | 5 | 4 | 0.05 | 0.3 | 0 | 0.6 | 0.3 |
| G58 | Balance | 12 | 5 | 4 | 0.1 | 0.3 | 0 | 0.6 | 0.3 |
| G59 | Balance | 12 | 5 | 4 | 0.6 | 0.3 | 0 | 0.6 | 0.3 |
| G60 | Balance | 12 | 5 | 4 | 0.7 | 0.3 | 0 | 0.6 | 0.3 |
| G61 | Balance | 12 | 5 | 4 | 2 | 0.3 | 0 | 0.6 | 0.3 |
| G62 | Balance | 12 | 5 | 4 | 5 | 0.3 | 0 | 0.6 | 0.3 |
| G63 | Balance | 12 | 5 | 4 | 7 | 0.3 | 0 | 0.6 | 0.3 |
| G64 | Balance | 12 | 5 | 4 | 0.3 | 0.05 | 0 | 0.6 | 0.3 |
| G65 | Balance | 12 | 5 | 4 | 0.3 | 0.1 | 0 | 0.6 | 0.3 |
| G66 | Balance | 12 | 5 | 4 | 0.3 | 0.2 | 0 | 0.6 | 0.3 |
| G67 | Balance | 12 | 5 | 4 | 0.3 | 0.6 | 0 | 0.6 | 0.3 |
| G68 | Balance | 12 | 5 | 4 | 0.3 | 0.7 | 0 | 0.6 | 0.3 |
| G69 | Balance | 12 | 5 | 4 | 0.3 | 1 | 0 | 0.6 | 0.3 |
| G70 | Balance | 12 | 5 | 4 | 0.3 | 0.05 | 0.03 | 0.6 | 0.3 |
| G71 | Balance | 12 | 5 | 4 | 0.3 | 0.1 | 0.07 | 0.6 | 0.3 |
| G72 | Balance | 12 | 5 | 4 | 0.3 | 0.2 | 0.13 | 0.6 | 0.3 |
| G73 | Balance | 12 | 5 | 4 | 0.3 | 0.3 | 0.2 | 0.6 | 0.3 |
| G74 | Balance | 12 | 5 | 4 | 0.3 | 0.6 | 0.4 | 0.6 | 0.3 |
| G75 | Balance | 12 | 5 | 4 | 0.3 | 0.7 | 0.47 | 0.6 | 0.3 |
| G76 | Balance | 12 | 5 | 4 | 0.3 | 1 | 0.67 | 0.6 | 0.3 |
| G77 | Balance | 12 | 5 | 4 | 0.3 | 1.5 | 1 | 0.6 | 0.3 |
| G78 | Balance | 0 | 1 | 0 | 0.3 | 0.3 | 0 | 0.6 | 0.3 |
| G79 | Balance | 2 | 1 | 0 | 0.3 | 0.3 | 0 | 0.6 | 0.3 |
| G80 | Balance | 3 | 1 | 0 | 0.3 | 0.3 | 0 | 0.6 | 0.3 |
| G81 | Balance | 7 | 1 | 0 | 0.3 | 0.3 | 0 | 0.6 | 0.3 |
| G82 | Balance | 8 | 1 | 0 | 0.3 | 0.3 | 0 | 0.6 | 0.3 |
| G83 | Balance | 10 | 1 | 0 | 0.3 | 0.3 | 0 | 0.6 | 0.3 |
| G84 | Balance | 5 | 1 | 0.9 | 0.3 | 0.3 | 0 | 0.6 | 0.3 |
| G85 | Balance | 5 | 1 | 1.4 | 0.3 | 0.3 | 0 | 0.6 | 0.3 |
| G86 | Balance | 5 | 1 | 4 | 0.3 | 0.3 | 0 | 0.6 | 0.3 |
| G87 | Balance | 5 | 1 | 0 | 0.05 | 0.3 | 0 | 0.6 | 0.3 |
| G88 | Balance | 5 | 1 | 0 | 0.1 | 0.3 | 0 | 0.6 | 0.3 |
| G89 | Balance | 5 | 1 | 0 | 0.6 | 0.3 | 0 | 0.6 | 0.3 |
| G90 | Balance | 5 | 1 | 0 | 0.7 | 0.3 | 0 | 0.6 | 0.3 |
| G91 | Balance | 5 | 1 | 0 | 2 | 0.3 | 0 | 0.6 | 0.3 |
| G92 | Balance | 5 | 1 | 0 | 5 | 0.3 | 0 | 0.6 | 0.3 |
| G93 | Balance | 5 | 1 | 0 | 7 | 0.3 | 0 | 0.6 | 0.3 |
| G94 | Balance | 5 | 1 | 0 | 0.3 | 0.05 | 0 | 0.6 | 0.3 |
| G95 | Balance | 5 | 1 | 0 | 0.3 | 0.1 | 0 | 0.6 | 0.3 |
| G96 | Balance | 5 | 1 | 0 | 0.3 | 0.2 | 0 | 0.6 | 0.3 |
| G97 | Balance | 5 | 1 | 0 | 0.3 | 0.6 | 0 | 0.6 | 0.3 |
| G98 | Balance | 5 | 1 | 0 | 0.3 | 0.7 | 0 | 0.6 | 0.3 |
| G99 | Balance | 5 | 1 | 0 | 0.3 | 1 | 0 | 0.6 | 0.3 |
| G100 | Balance | 5 | 1 | 0 | 0.3 | 0.05 | 0.03 | 0.6 | 0.3 |
| G101 | Balance | 5 | 1 | 0 | 0.3 | 0.1 | 0.07 | 0.6 | 0.3 |
| G102 | Balance | 5 | 1 | 0 | 0.3 | 0.2 | 0.13 | 0.6 | 0.3 |
| G103 | Balance | 5 | 1 | 0 | 0.3 | 0.3 | 0.2 | 0.6 | 0.3 |
| G104 | Balance | 5 | 1 | 0 | 0.3 | 0.6 | 0.4 | 0.6 | 0.3 |
| G105 | Balance | 5 | 1 | 0 | 0.3 | 0.7 | 0.47 | 0.6 | 0.3 |
| G106 | Balance | 5 | 1 | 0 | 0.3 | 1 | 0.67 | 0.6 | 0.3 |
| G107 | Balance | 5 | 1 | 0 | 0.3 | 1.5 | 1 | 0.6 | 0.3 |

TABLE 1-continued

| Powder | Powder Composition (wt %) | | | | | | | | |
|---|---|---|---|---|---|---|---|---|---|
| No. | Fe | W | V | Cr | Si | Mn | S | C | O |
| G108 | Balance | 5 | 0 | 0 | 2 | 0.3 | 0.2 | 0.6 | 0.3 |
| G109 | Balance | 5 | 1 | 0 | 2 | 0.3 | 0.2 | 0.6 | 0.3 |
| G110 | Balance | 12 | 5 | 4 | 2 | 0.3 | 0.2 | 0.6 | 0.3 |
| G111 | Balance of Fe, 6.5 wt % Co, 1.5 wt % Ni, and 1.5 wt % Mo | | | | | | | | |
| G112 | Balance of Co, 28 wt % Mo, 8.5 wt % Cr, and 2.5 wt % Si | | | | | | | | |
| G113 | MnS Powder | | | | | | | | |

TABLE 2

| | | Powder Mixture Composition (parts by weight) | | | | |
|---|---|---|---|---|---|---|
| | Sample No. | Powder for 1st Phase | Powder for 2nd Phase | Graphite Powder | Lubricant (Zinc Stearate) | MnS Powder |
| W cont. in 1st Phase (wt %) | | | | | | |
| 0 | 1 | G1 (50) | G41 (50) | 0.85 | 0.5 | — |
| 2 | 2 | G2 (50) | G41 (50) | 0.86 | 0.5 | — |
| 3 | 3 | G3 (50) | G41 (50) | 0.87 | 0.5 | — |
| 5 | 4 | G4 (50) | G41 (50) | 0.88 | 0.5 | — |
| 7 | 5 | G5 (50) | G41 (50) | 0.89 | 0.5 | — |
| 8 | 6 | G6 (50) | G41 (50) | 0.89 | 0.5 | — |
| 10 | 7 | G7 (50) | G41 (50) | 0.90 | 0.5 | — |
| W cont. in 2nd Phase (wt %) | | | | | | |
| 0 | 8 | G4 (50) | G37 (50) | 0.82 | 0.5 | — |
| 2 | 9 | G4 (50) | G38 (50) | 0.83 | 0.5 | — |
| 3 | 10 | G4 (50) | G39 (50) | 0.83 | 0.5 | — |
| 7 | 11 | G4 (50) | G40 (50) | 0.85 | 0.5 | — |
| 12 | 4 | G4 (50) | G41 (50) | 0.88 | 0.5 | — |
| 15 | 12 | G4 (50) | G42 (50) | 0.89 | 0.5 | — |
| 16 | 13 | G4 (50) | G43 (50) | 0.90 | 0.5 | — |
| 18 | 14 | G4 (50) | G44 (50) | 0.91 | 0.5 | — |
| V cont. in 2nd Phase (wt %) | | | | | | |
| 0 | 15 | G4 (50) | G45 (50) | 0.59 | 0.5 | — |
| 1 | 16 | G4 (50) | G46 (50) | 0.64 | 0.5 | — |
| 2 | 17 | G4 (50) | G47 (50) | 0.70 | 0.5 | — |
| 5 | 4 | G4 (50) | G41 (50) | 0.88 | 0.5 | — |
| 7 | 18 | G4 (50) | G48 (50) | 0.99 | 0.5 | — |
| 8 | 19 | G4 (50) | G49 (50) | 1.05 | 0.5 | — |
| V cont. in. 2nd Phase (wt %) | | | | | | |
| 10 | 20 | G4 (50) | G50 (50) | 1.17 | 0.5 | — |
| V cont. in 1st Phase (wt %) | | | | | | |
| 0 | 4 | G4 (50) | G41 (50) | 0.88 | 0.5 | — |
| 0.5 | 21 | G8 (50) | G41 (50) | 0.90 | 0.5 | — |
| 1 | 22 | G9 (50) | G41 (50) | 0.93 | 0.5 | — |
| 1.5 | 23 | G10 (50) | G41 (50) | 0.96 | 0.5 | — |
| 2 | 24 | G11 (50) | G41 (50) | 0.99 | 0.5 | — |
| 5 | 25 | G12 (50) | G41 (50) | 1.17 | 0.5 | — |
| Cr cont. in 2nd Phase (wt %) | | | | | | |
| 0 | 26 | G4 (50) | G51 (50) | 0.88 | 0.5 | — |
| 1 | 27 | G4 (50) | G52 (50) | 0.88 | 0.5 | — |
| 2 | 28 | G4 (50) | G53 (50) | 0.88 | 0.5 | — |

TABLE 2-continued

| | | Powder Mixture Composition (parts by weight) | | | | |
|---|---|---|---|---|---|---|
| | Sample No. | Powder for 1st Phase | Powder for 2nd Phase | Graphite Powder | Lubricant (Zinc Stearate) | MnS Powder |
| 4 | 4 | G4 (50) | G41 (50) | 0.88 | 0.5 | — |
| 7 | 29 | G4 (50) | G54 (50) | 0.88 | 0.5 | — |
| 8 | 30 | G4 (50) | G55 (50) | 0.88 | 0.5 | — |
| 10 | 31 | G12 (50) | G56 (50) | 0.88 | 0.5 | — |
| Cr cont. in 1st Phase (wt %) | | | | | | |
| 0 | 4 | G4 (50) | G41 (50) | 0.88 | 0.5 | — |
| 0.9 | 32 | G13 (50) | G41 (50) | 0.88 | 0.5 | — |
| 1.4 | 33 | G14 (50) | G41 (50) | 0.88 | 0.5 | — |
| 4 | 34 | G1S (50) | G41 (50) | 0.88 | 0.5 | — |
| 4 | 35 | G1S (50) | G51 (50) | 0.88 | 0.5 | — |
| Ratio of 1st Phase to 2nd Phase by wt. | | | | | | |
| 100:0 | 36 | G4 | — | 0.55 | 0.5 | — |
| 90:10 | 37 | G4 | G41 | 0.62 | 0.5 | — |
| 80:20 | 38 | G4 | G41 | 0.68 | 0.5 | — |
| 50:50 | 4 | G4 | G41 | 0.88 | 0.5 | — |
| 20:80 | 39 | G4 | G41 | 1.07 | 0.5 | — |
| 10:90 | 40 | G4 | G41 | 1.14 | 0.5 | — |
| 0:100 | 41 | — | G41 | 1.20 | 0.5 | — |
| | Com. Sample A | G111 (84.15), G112 (15), and Stamped Lead Powder (2) | | 0.85 | 0.5 | — |
| Si cont. in 1st or 2nd Phase (wt %) | | | | | | |
| 0.05 | 42 | G16 (50) | G57 (50) | 0.88 | 0.5 | — |
| 0.1 | 43 | G17 (50) | G58 (50) | 0.88 | 0.5 | — |
| 0.3 | 4 | G4 (50) | G41 (50) | 0.88 | 0.5 | — |
| 0.6 | 44 | G18 (50) | G59 (50) | 0.88 | 0.5 | — |
| 0.7 | 45 | G19 (50) | G60 (50) | 0.88 | 0.5 | — |
| 2 | 46 | G20 (50) | G61 (50) | 0.88 | 0.5 | — |
| 5 | 47 | G21 (50) | G62 (50) | 0.88 | 0.5 | — |
| 7 | 48 | G22 (50) | G63 (50) | 0.88 | 0.5 | — |
| Mn cont. in 1st or 2nd Phase (wt %) | | | | | | |
| 0.05 | 49 | G23 (50) | G64 (50) | 0.88 | 0.5 | — |
| 0.1 | 50 | G24 (50) | G65 (50) | 0.88 | 0.5 | — |
| 0.2 | 51 | G25 (50) | G66 (50) | 0.88 | 0.5 | — |
| 0.3 | 4 | G4 (50) | G41 (50) | 0.88 | 0.5 | — |
| 0.6 | 52 | G26 (50) | G67 (50) | 0.88 | 0.5 | — |
| 0.7 | 53 | G27 (50) | G68 (50) | 0.88 | 0.5 | — |
| 1 | 54 | G28 (50) | G69 (50) | 0.88 | 0.5 | — |
| Precipitated MnS cont. in 1st or 2nd Phase (wt %) | | | | | | |
| 0.08 | 55 | G29 (50) | G70 (50) | 0.88 | 0.5 | — |
| 0.17 | 56 | G30 (50) | G71 (50) | 0.88 | 0.5 | — |
| 0.33 | 57 | G31 (50) | G72 (50) | 0.88 | 0.5 | — |
| 0.5 | 58 | G32 (50) | G73 (50) | 0.88 | 0.5 | — |
| 1 | 59 | G33 (50) | G74 (50) | 0.88 | 0.5 | — |
| 1.17 | 60 | G34 (50) | G75 (50) | 0.88 | 0.5 | — |
| 1.67 | 61 | G35 (50) | G76 (50) | 0.88 | 0.5 | — |
| 2.5 | 62 | G36 (50) | G77 (50) | 0.88 | 0.5 | — |
| (MnS + Si) cont. in 1st or 2nd Phase (wt %) | | | | | | |
| 0.3 | 4 | G4 (50) | G41 (50) | 0.88 | 0.5 | — |
| 2.5 | 63 | G108 (50) | G110 (50) | 0.88 | 0.5 | — |

TABLE 2-continued

| | Sample No. | Powder Mixture Composition (parts by weight) Powder for 1st Phase | Powder for 2nd Phase | Graphite Powder | Lubricant (Zinc Stearate) | MnS Powder |
|---|---|---|---|---|---|---|
| MnS Powder (parts by weight) | | | | | | |
| 0 | 4 | G4 (50) | G41 (50) | 0.88 | 0.5 | 0 |
| 0.1 | 64 | | | | | 0.1 |
| 0.2 | 65 | | | | | 0.2 |
| 0.3 | 66 | | | | | 0.3 |
| 0.5 | 67 | | | | | 0.5 |
| 1.0 | 68 | | | | | 1.0 |
| 1.2 | 69 | | | | | 1.2 |
| 1.6 | 70 | | | | | 1.6 |
| 2.5 | 71 | | | | | 2.5 |
| MnS Powder & Si in 1st and 2nd Phases (parts by wt.) | | | | | | |
| 0.3 | 4 | G4 (50) | G41 (50) | 0.88 | 0.5 | 0 |
| 2.5 | 72 | G20 (50) | G61 (50) | 0.88 | 0.5 | 0.5 |
| W cont. in 1st Phase (wt %) | | | | | | |
| 0 | 73 | G78 (50) | G41 (50) | 0.91 | 0.5 | — |
| 2 | 74 | G79 (50) | G41 (50) | 0.92 | 0.5 | — |
| 3 | 75 | G80 (50) | G41 (50) | 0.92 | 0.5 | — |
| 5 | 22 | G9 (50) | G41 (50) | 0.93 | 0.5 | — |
| 7 | 76 | G81 (50) | G44 (50) | 0.94 | 0.5 | — |
| 8 | 77 | G82 (50) | G41 (50) | 0.95 | 0.5 | — |
| 10 | 78 | G83 (50) | G41 (50) | 0.96 | 0.5 | — |
| W cont. in 2nd Phase (wt %) | | | | | | |
| 0 | 79 | G9 (50) | G37 (50) | 0.87 | 0.5 | — |
| 2 | 80 | G9 (50) | G38 (50) | 0.88 | 0.5 | — |
| 3 | 81 | G9 (50) | G39 (50) | 0.89 | 0.5 | — |
| 7 | 82 | G9 (50) | G40 (50) | 0.91 | 0.5 | — |
| 12 | 22 | G9 (50) | G41 (50) | 0.93 | 0.5 | — |
| 15 | 83 | G9 (50) | G42 (50) | 0.95 | 0.5 | — |
| 16 | 84 | G9 (50) | G43 (50) | 0.95 | 0.5 | — |
| 18 | 85 | G9 (50) | G44 (50) | 0.96 | 0.5 | — |
| V cont. in 2nd Phase (wt %) | | | | | | |
| 0 | 86 | G9 (50) | G45 (50) | 0.64 | 0.5 | — |
| 1 | 87 | G9 (50) | G46 (50) | 0.70 | 0.5 | — |
| 2 | 88 | G9 (50) | G47 (50) | 0.76 | 0.5 | — |
| 5 | 22 | G9 (50) | G41 (50) | 0.93 | 0.5 | — |
| 7 | 89 | G9 (50) | G48 (50) | 1.05 | 0.5 | — |
| 8 | 90 | G9 (50) | G49 (50) | 1.11 | 0.5 | — |
| 10 | 91 | G9 (50) | GSO (50) | 1.22 | 0.5 | — |
| Cr cont. in 2nd Phase (wt %) | | | | | | |
| 0 | 92 | G9 (50) | G51 (50) | 0.93 | 0.5 | — |
| 1 | 93 | G9 (50) | G52 (50) | 0.93 | 0.5 | — |
| 2 | 94 | G9 (50) | G53 (50) | 0.93 | 0.5 | — |
| 4 | 22 | G9 (50) | G41 (50) | 0.93 | 0.5 | — |
| 7 | 95 | G9 (50) | G54 (50) | 0.93 | 0.5 | — |
| 8 | 96 | G9 (50) | G55 (50) | 0.93 | 0.5 | — |
| 10 | 97 | G9 (50) | G56 (50) | 0.93 | 0.5 | — |

TABLE 2-continued

| | Sample No. | Powder Mixture Composition (parts by weight) Powder for 1st Phase | Powder for 2nd Phase | Graphite Powder | Lubricant (Zinc Stearate) | MnS Powder |
|---|---|---|---|---|---|---|
| Cr cont. in 1st Phase (wt %) | | | | | | |
| 0.2 | 22 | G9 (50) | G41 (50) | 0.93 | 0.5 | — |
| 1 | 98 | G84 (50) | G41 (50) | 0.93 | 0.5 | — |
| 1.5 | 99 | G85 (50) | G41 (50) | 0.93 | 0.5 | — |
| 4 | 100 | G86 (50) | G41 (50) | 0.93 | 0.5 | — |
| 4 | 101 | G86 (50) | G51 (50) | 0.93 | 0.5 | — |
| Ratio of 1st Phase to 2nd Phase by wt. | | | | | | |
| 100:0 | 102 | G9 | — | 0.57 | 0.5 | — |
| 90:10 | 103 | G9 | G41 | 0.72 | 0.5 | — |
| 80:20 | 104 | G9 | G41 | 0.77 | 0.5 | — |
| 50:50 | 22 | G9 | G41 | 0.93 | 0.5 | — |
| 20:80 | 105 | G9 | G41 | 1.09 | 0.5 | — |
| 10:90 | 106 | G9 | G41 | 1.15 | 0.5 | — |
| 0:100 | 107 | — | G41 | 1.20 | 0.5 | — |
| Si cont. in 1st or 2nd Phase (wt %) | | | | | | |
| 0.05 | 108 | G87 (50) | G57 (50) | 0.93 | 0.5 | — |
| 0.1 | 109 | G88 (50) | G58 (50) | 0.93 | 0.5 | — |
| 0.3 | 22 | G9 (50) | G41 (50) | 0.93 | 0.5 | — |
| 0.6 | 110 | G89 (50) | G59 (50) | 0.93 | 0.5 | — |
| 0.7 | 111 | G90 (50) | G60 (50) | 0.93 | 0.5 | — |
| 2 | 112 | G91 (50) | G61 (50) | 0.93 | 0.5 | — |
| 5 | 113 | G92 (50) | G62 (50) | 0.93 | 0.5 | — |
| 7 | 114 | G93 (50) | G63 (50) | 0.93 | 0.5 | — |
| Mn cont. in 1st or 2nd Phase (wt %) | | | | | | |
| 0.05 | 115 | G94 (50) | G64 (50) | 0.93 | 0.5 | — |
| 0.1 | 116 | G95 (50) | G65 (50) | 0.93 | 0.5 | — |
| 0.2 | 117 | G96 (50) | G66 (50) | 0.93 | 0.5 | — |
| 0.3 | 22 | G9 (50) | G41 (50) | 0.93 | 0.5 | — |
| 0.6 | 118 | G97 (50) | G67 (50) | 0.93 | 0.5 | — |
| 0.7 | 119 | G98 (50) | G68 (50) | 0.93 | 0.5 | — |
| 1 | 120 | G99 (50) | G69 (50) | 0.93 | 0.5 | — |
| Precipitated MnS cont. in 1st or 2nd Phase (wt %) | | | | | | |
| 0.08 | 121 | G100 (50) | G70 (50) | 0.93 | 0.5 | — |
| 0.17 | 122 | G101 (50) | G71 (50) | 0.93 | 0.5 | — |
| 0.33 | 123 | G102 (50) | G72 (50) | 0.93 | 0.5 | — |
| 0.5 | 124 | G103 (50) | G73 (50) | 0.93 | 0.5 | — |
| 1 | 125 | G104 (50) | G74 (50) | 0.93 | 0.5 | — |
| 1.17 | 126 | G105 (50) | G75 (50) | 0.93 | 0.5 | — |
| 1.67 | 127 | G106 (50) | G76 (50) | 0.93 | 0.5 | — |
| 2.5 | 128 | G107 (50) | G77 (50) | 0.93 | 0.5 | — |
| (MnS + Si) cont. in 1st or 2nd Phase (wt %) | | | | | | |
| 0.3 | 22 | G9 (50) | G41 (50) | 0.93 | 0.5 | — |
| 2.5 | 129 | G109 (50) | G110 (50) | 0.93 | 0.5 | — |
| MnS Powder (parts by weight) | | | | | | |
| 0 | 22 | G9 (50) | G41 (50) | 0.93 | 0.5 | 0 |
| 0.1 | 130 | | | | | 0.1 |
| 0.2 | 131 | | | | | 0.2 |
| 0.3 | 132 | | | | | 0.3 |

TABLE 2-continued

| | Sample No. | Powder Mixture Composition (parts by weight): Powder for 1st Phase | Powder for 2nd Phase | Graphite Powder | Lubricant (Zinc Stearate) | MnS Powder |
|---|---|---|---|---|---|---|
| 0.5 | 133 | | | | | 0.5 |
| 1.0 | 134 | | | | | 1.0 |
| 1.2 | 135 | | | | | 1.2 |
| 1.6 | 136 | | | | | 1.6 |
| 2.5 | 137 | | | | | 2.5 |

TABLE 2-continued

| | Sample No. | Powder Mixture Composition (parts by weight): Powder for 1st Phase | Powder for 2nd Phase | Graphite Powder | Lubricant (Zinc Stearate) | MnS Powder |
|---|---|---|---|---|---|---|
| MnS Powder & Si in 1st and 2nd Phases (parts by wt.) | | | | | | |
| 0.3 | 22 | G9 (50) | G41 (50) | 0.93 | 0.5 | 0 |
| 2.5 | 138 | G91 (50) | G61 (50) | 0.93 | 0.5 | 0.5 |

TABLE 3a

| | Sample No. | Sintered Alloy Composition (wt %): First Phase Fe | W | V | Cr | Si | Mn | S | Second Phase Fe | W | V | Cr | Si | Mn | S | Total C |
|---|---|---|---|---|---|---|---|---|---|---|---|---|---|---|---|---|
| W cont. in 1st Phase (wt %) | | | | | | | | | | | | | | | | |
| 0 | 1 | Bal. | 0 | 0 | 0.2 | 0.3 | 0.3 | 0 | Bal. | 12 | 5 | 4 | 0.3 | 0.3 | 0 | 1.15 |
| 2 | 2 | Bal. | 2 | 0 | 0.2 | 0.3 | 0.3 | 0 | Bal. | 12 | 5 | 4 | 0.3 | 0.3 | 0 | 1.16 |
| 3 | 3 | Bal. | 3 | 0 | 0.2 | 0.3 | 0.3 | 0 | Bal. | 12 | 5 | 4 | 0.3 | 0.3 | 0 | 1.17 |
| 5 | 4 | Bal. | 5 | 0 | 0.2 | 0.3 | 0.3 | 0 | Bal. | 12 | 5 | 4 | 0.3 | 0.3 | 0 | 1.18 |
| 7 | 5 | Bal. | 7 | 0 | 0.2 | 0.3 | 0.3 | 0 | Bal. | 12 | 5 | 4 | 0.3 | 0.3 | 0 | 1.19 |
| 8 | 6 | Bal. | 8 | 0 | 0.2 | 0.3 | 0.3 | 0 | Bal. | 12 | 5 | 4 | 0.3 | 0.3 | 0 | 1.19 |
| 10 | 7 | Bal. | 10 | 0 | 0.2 | 0.3 | 0.3 | 0 | Bal. | 12 | 5 | 4 | 0.3 | 0.3 | 0 | 1.20 |
| W cont. in 2nd Phase (wt %) | | | | | | | | | | | | | | | | |
| 0 | 8 | Bal. | 5 | 0 | 0.2 | 0.3 | 0.3 | 0 | Bal. | 0 | 5 | 4 | 0.3 | 0.3 | 0 | 1.12 |
| 2 | 9 | Bal. | 5 | 0 | 0.2 | 0.3 | 0.3 | 0 | Bal. | 2 | 5 | 4 | 0.3 | 0.3 | 0 | 1.13 |
| 3 | 10 | Bal. | 5 | 0 | 0.2 | 0.3 | 0.3 | 0 | Bal. | 3 | 5 | 4 | 0.3 | 0.3 | 0 | 1.13 |
| 7 | 11 | Bal. | 5 | 0 | 0.2 | 0.3 | 0.3 | 0 | Bal. | 7 | 5 | 4 | 0.3 | 0.3 | 0 | 1.15 |
| 12 | 4 | Bal. | 5 | 0 | 0.2 | 0.3 | 0.3 | 0 | Bal. | 12 | 5 | 4 | 0.3 | 0.3 | 0 | 1.18 |
| 15 | 12 | Bal. | 5 | 0 | 0.2 | 0.3 | 0.3 | 0 | Bal. | 15 | 5 | 4 | 0.3 | 0.3 | 0 | 1.19 |
| 16 | 13 | Bal. | 5 | 0 | 0.2 | 0.3 | 0.3 | 0 | Bal. | 16 | 5 | 4 | 0.3 | 0.3 | 0 | 1.20 |
| 18 | 14 | Bal. | 5 | 0 | 0.2 | 0.3 | 0.3 | 0 | Bal. | 18 | 5 | 4 | 0.3 | 0.3 | 0 | 1.21 |

TABLE 3b

| | Sample No. | Sintered Alloy Composition (wt %): First Phase Fe | W | V | Cr | Si | Mn | S | Second Phase Fe | W | V | Cr | Si | Mn | S | Total C |
|---|---|---|---|---|---|---|---|---|---|---|---|---|---|---|---|---|
| V cont. in 2nd Phase (wt %) | | | | | | | | | | | | | | | | |
| 0 | 15 | Bal. | 5 | 0 | 0.2 | 0.3 | 0.3 | 0 | Bal. | 12 | 0 | 4 | 0.3 | 0.3 | 0 | 0.89 |
| 1 | 16 | Bal. | 5 | 0 | 0.2 | 0.3 | 0.3 | 0 | Bal. | 12 | 1 | 4 | 0.3 | 0.3 | 0 | 0.94 |
| 2 | 17 | Bal. | 5 | 0 | 0.2 | 0.3 | 0.3 | 0 | Bal. | 12 | 2 | 4 | 0.3 | 0.3 | 0 | 1.00 |
| 5 | 4 | Bal. | 5 | 0 | 0.2 | 0.3 | 0.3 | 0 | Bal. | 12 | 5 | 4 | 0.3 | 0.3 | 0 | 1.18 |
| 7 | 18 | Bal. | 5 | 0 | 0.2 | 0.3 | 0.3 | 0 | Bal. | 12 | 7 | 4 | 0.3 | 0.3 | 0 | 1.29 |
| 8 | 19 | Bal. | 5 | 0 | 0.2 | 0.3 | 0.3 | 0 | Bal. | 12 | 8 | 4 | 0.3 | 0.3 | 0 | 1.35 |
| 10 | 20 | Bal. | 5 | 0 | 0.2 | 0.3 | 0.3 | 0 | Bal. | 12 | 10 | 4 | 0.3 | 0.3 | 0 | 1.47 |
| V cont. in 1st Phase (wt %) | | | | | | | | | | | | | | | | |
| 0 | 4 | Bal. | 5 | 0 | 0.2 | 0.3 | 0.3 | 0 | Bal. | 12 | 5 | 4 | 0.3 | 0.8 | 0 | 1.18 |
| 0.5 | 21 | Bal. | 5 | 0.5 | 0.2 | 0.3 | 0.3 | 0 | Bal. | 12 | 5 | 4 | 0.3 | 0.3 | 0 | 1.20 |

TABLE 3b-continued

| | Sample No. | Sintered Alloy Composition (wt %) First Phase Fe | W | V | Cr | Si | Mn | S | Second Phase Fe | W | V | Cr | Si | Mn | S | Total C |
|---|---|---|---|---|---|---|---|---|---|---|---|---|---|---|---|---|
| 1 | 22 | Bal. | 5 | 1 | 0.2 | 0.3 | 0.3 | 0 | Bal. | 12 | 5 | 4 | 0.3 | 0.3 | 0 | 1.23 |
| 1.5 | 23 | Bal. | 5 | 1.5 | 0.2 | 0.3 | 0.3 | 0 | Bal. | 12 | 5 | 4 | 0.3 | 0.3 | 0 | 1.26 |
| 2 | 24 | Bal. | 5 | 2 | 0.2 | 0.3 | 0.3 | 0 | Bal. | 12 | 5 | 4 | 0.3 | 0.3 | 0 | 1.29 |
| 5 | 25 | Bal. | 5 | 5 | 0.2 | 0.3 | 0.3 | 0 | Bal. | 12 | 5 | 4 | 0.3 | 0.3 | 0 | 1.47 |

TABLE 3c

| | Sample No. | Sintered Alloy Composition (wt %) First Phase Fe | W | V | Cr | Si | Mn | S | Second Phase Fe | W | V | Cr | Si | Mn | S | Total C |
|---|---|---|---|---|---|---|---|---|---|---|---|---|---|---|---|---|
| Cr cont. in 2nd Phase (wt %) | | | | | | | | | | | | | | | | |
| 0 | 26 | Bal. | 5 | 0 | 0 | 0.3 | 0.3 | 0 | Bal. | 12 | 5 | 0 | 0.3 | 0.3 | 0 | 1.18 |
| 1 | 27 | Bal. | 5 | 0 | 0.05 | 0.3 | 0.3 | 0 | Bal. | 12 | 5 | 1 | 0.3 | 0.3 | 0 | 1.18 |
| 2 | 28 | Bal. | 5 | 0 | 0.1 | 0.3 | 0.3 | 0 | Bal. | 12 | 5 | 2 | 0.3 | 0.3 | 0 | 1.18 |
| 4 | 4 | Bal. | 5 | 0 | 0.2 | 0.3 | 0.3 | 0 | Bal. | 12 | 5 | 4 | 0.3 | 0.3 | 0 | 1.18 |
| 7 | 29 | Bal. | 5 | 0 | 0.35 | 0.3 | 0.3 | 0 | Bal. | 12 | 5 | 7 | 0.3 | 0.3 | 0 | 1.18 |
| 8 | 30 | Bal. | 5 | 0 | 0.4 | 0.3 | 0.3 | 0 | Bal. | 12 | 5 | 8 | 0.3 | 0.3 | 0 | 1.18 |
| 10 | 31 | Bal. | 5 | 0 | 0.s | 0.3 | 0.3 | 0 | Bal. | 12 | 5 | 10 | 0.3 | 0.3 | 0 | 1.15 |
| Cr cont. in 1st Phase (wt %) | | | | | | | | | | | | | | | | |
| 0 | 4 | Bal. | 5 | 0 | 0.2 | 0.3 | 0.3 | 0 | Bal. | 12 | 5 | 4 | 0.3 | 0.3 | 0 | 1.18 |
| 0.9 | 32 | Bal. | 5 | 0 | 1 | 0.3 | 0.3 | 0 | Bal. | 12 | 5 | 4 | 0.3 | 0.3 | 0 | 1.18 |
| 1.4 | 33 | Bal. | 5 | 0 | 1.5 | 0.3 | 0.3 | 0 | Bal. | 12 | 5 | 4 | 0.3 | 0.3 | 0 | 1.18 |
| 4 | 34 | Bal. | 5 | 0 | 4 | 0.3 | 0.3 | 0 | Bal. | 12 | 5 | 4 | 0.3 | 0.3 | 0 | 1.18 |
| 4 | 35 | Bal. | 5 | 0 | 4 | 0.3 | 0.3 | 0 | Bal. | 12 | 5 | 0.2 | 0.3 | 0.3 | 0 | 1.18 |

40

TABLE 3d

| | Sample No. | Sintered Alloy Composition (wt %) First Phase Fe | W | V | Cr | Si | Mn | S | Second Phase Fe | W | V | Cr | Si | Mn | S | Total C |
|---|---|---|---|---|---|---|---|---|---|---|---|---|---|---|---|---|
| Ratio of 1st Phase to 2nd Phase by wt. | | | | | | | | | | | | | | | | |
| 100:0 | 36 | Bal. | 5 | 0 | 0.2 | 0.3 | 0.3 | 0 | Bal. | 12 | 5 | 4 | 0.3 | 0.3 | 0 | 0.85 |
| 90:10 | 37 | Bal. | 5 | 0 | 0.2 | 0.3 | 0.3 | 0 | Bal. | 12 | 5 | 4 | 0.3 | 0.3 | 0 | 0.92 |
| 80:20 | 38 | Bal. | 5 | 0 | 0.2 | 0.3 | 0.3 | 0 | Bal. | 12 | 5 | 4 | 0.3 | 0.3 | 0 | 0.98 |
| 50:50 | 4 | Bal. | 5 | 0 | 0.2 | 0.3 | 0.3 | 0 | Bal. | 12 | 5 | 4 | 0.3 | 0.3 | 0 | 1.18 |
| 20:80 | 39 | Bal. | 5 | 0 | 0.2 | 0.3 | 0.3 | 0 | Bal. | 12 | 5 | 4 | 0.3 | 0.3 | 0 | 1.37 |
| 10:90 | 40 | Bal. | 5 | 0 | 0.2 | 0.3 | 0.3 | 0 | Bal. | 12 | 5 | 4 | 0.3 | 0.3 | 0 | 1.44 |
| 0:100 | 41 | Bal. | 5 | 0 | 0.2 | 0.3 | 0.3 | 0 | Bal. | 12 | 5 | 4 | 0.3 | 0.3 | 0 | 1.50 |
| Comparative Sample A | | Fe-6.5Co-1.5Ni-1.5Mo-0.6Pb + 15%Co-28Mo-8.5Cr-2.5Si, with Pb impregnation | | | | | | | | | | | | | | |

TABLE 3e

| | Sample No. | Sintered Alloy Composition (wt %) First Phase Fe | W | V | Cr | Si | Mn | S | Second Phase Fe | W | V | Cr | Si | Mn | S | Total C |
|---|---|---|---|---|---|---|---|---|---|---|---|---|---|---|---|---|
| Si cont. in 1st or 2nd Phase (wt %) | | | | | | | | | | | | | | | | |
| 0.05 | 42 | Bal. | 5 | 0 | 0.2 | 0.05 | 0.3 | 0 | Bal. | 12 | 5 | 4 | 0.05 | 0.3 | 0 | 1.18 |
| 0.1 | 43 | Bal. | 5 | 0 | 0.2 | 0.1 | 0.3 | 0 | Bal. | 12 | 5 | 4 | 0.1 | 0.3 | 0 | 1.18 |
| 0.3 | 4 | Bal. | 5 | 0 | 0.2 | 0.3 | 0.3 | 0 | Bal. | 12 | 5 | 4 | 0.3 | 0.3 | 0 | 1.18 |
| 0.6 | 44 | Bal. | 5 | 0 | 0.2 | 0.6 | 0.3 | 0 | Bal. | 12 | 5 | 4 | 0.6 | 0.3 | 0 | 1.18 |
| 0.7 | 45 | Bal. | 5 | 0 | 0.2 | 0.7 | 0.3 | 0 | Bal. | 12 | 5 | 4 | 0.7 | 0.3 | 0 | 1.18 |
| 2 | 46 | Bal. | 5 | 0 | 0.2 | 2 | 0.3 | 0 | Bal. | 12 | 5 | 4 | 2 | 0.3 | 0 | 1.18 |
| 5 | 47 | Bal. | 5 | 0 | 0.2 | 5 | 0.3 | 0 | Bal. | 12 | 5 | 4 | 5 | 0.3 | 0 | 1.18 |
| 7 | 48 | Bal. | 5 | 0 | 0.2 | 7 | 0.3 | 0 | Bal. | 12 | 5 | 4 | 7 | 0.3 | 0 | 1.18 |
| Mn cont. in 1st or 2nd Phase (wt %) | | | | | | | | | | | | | | | | |
| 0.05 | 49 | Bal. | 5 | 0 | 0.2 | 0.3 | 0.05 | 0 | Bal. | 12 | 5 | 4 | 0.3 | 0.05 | 0 | 1.18 |
| 0.1 | 50 | Bal. | 5 | 0 | 0.2 | 0.3 | 0.1 | 0 | Bal. | 12 | 5 | 4 | 0.3 | 0.1 | 0 | 1.18 |
| 0.2 | 51 | Bal. | 5 | 0 | 0.2 | 0.3 | 0.2 | 0 | Bal. | 12 | 5 | 4 | 0.3 | 0.2 | 0 | 1.18 |
| 0.3 | 4 | Bal. | 5 | 0 | 0.2 | 0.3 | 0.3 | 0 | Bal. | 12 | 5 | 4 | 0.3 | 0.3 | 0 | 1.18 |
| 0.6 | 52 | Bal. | 5 | 0 | 0.2 | 0.3 | 0.6 | 0 | Bal. | 12 | 5 | 4 | 0.3 | 0.6 | 0 | 1.18 |
| 0.7 | 53 | Bal. | 5 | 0 | 0.2 | 0.3 | 0.7 | 0 | Bal. | 12 | 5 | 4 | 0.3 | 0.7 | 0 | 1.18 |
| 1 | 54 | Bal. | 5 | 0 | 0.2 | 0.3 | 1 | 0 | Bal. | 12 | 5 | 4 | 0.3 | 1 | 0 | 1.18 |

TABLE 3f

| | Sample No. | Sintered Alloy Composition (wt %) First Phase Fe | W | V | Cr | Si | Mn | S | Second Phase Fe | W | V | Cr | Si | Mn | S | Total C |
|---|---|---|---|---|---|---|---|---|---|---|---|---|---|---|---|---|
| Precipitated MnS cont. in 1st or 2nd Phase (wt %) | | | | | | | | | | | | | | | | |
| 0.08 | 55 | Bal. | 5 | 0 | 0.2 | 0.3 | 0.05 | 0.03 | Bal. | 12 | 5 | 4 | 0.3 | 0.05 | 0.03 | 1.18 |
| 0.17 | 56 | Bal. | 5 | 0 | 0.2 | 0.3 | 0.1 | 0.07 | Bal. | 12 | 5 | 4 | 0.3 | 0.1 | 0.07 | 1.18 |
| 0.33 | 57 | Bal. | 5 | 0 | 0.2 | 0.3 | 0.2 | 0.13 | Bal. | 12 | 5 | 4 | 0.3 | 0.2 | 0.13 | 1.18 |
| 0.5 | 58 | Bal. | 5 | 0 | 0.2 | 0.3 | 0.3 | 0.2 | Bal. | 12 | 5 | 4 | 0.3 | 0.3 | 0.2 | 1.18 |
| 1 | 59 | Bal. | 5 | 0 | 0.2 | 0.3 | 0.6 | 0.4 | Bal. | 12 | 5 | 4 | 0.3 | 0.6 | 0.4 | 1.18 |
| 1.17 | 60 | Bal. | 5 | 0 | 0.2 | 0.3 | 0.7 | 0.47 | Bal. | 12 | 5 | 4 | 0.3 | 0.7 | 0.47 | 1.18 |
| 1.67 | 61 | Bal. | 5 | 0 | 0.2 | 0.3 | 1 | 0.67 | Bal. | 12 | 5 | 4 | 0.3 | 1 | 0.67 | 1.18 |
| 2.5 | 62 | Bal. | 5 | 0 | 0.2 | 0.3 | 1.5 | 1 | Bal. | 12 | 5 | 4 | 0.3 | 1.5 | 1 | 1.18 |
| Precipitated MnS + Si) cont. in 1st or 2nd Phase (wt %) | | | | | | | | | | | | | | | | |
| 0.3 | 4 | Bal. | 5 | 0 | 0.2 | 0.3 | 0.05 | 0 | Bal. | 12 | 5 | 4 | 0.3 | 0.05 | 0 | 1.18 |
| 2.5 | 63 | Bal. | 5 | 0 | 0.2 | 0.3 | 0.1 | 0 | Bal. | 12 | 5 | 4 | 0.3 | 0.1 | 0 | 1.18 |

TABLE 3g

| | Sample No. | Sintered Alloy Composition (wt %) First Phase Fe | W | V | Cr | Si | Mn | S | Second Phase Fe | W | V | Cr | Si | Mn | S | Total C |
|---|---|---|---|---|---|---|---|---|---|---|---|---|---|---|---|---|
| Added MnS Powder (parts by weight) | | | | | | | | | | | | | | | | |
| 0 | 4 | Bal. | 5 | 0 | 0.2 | 0.3 | 0.3 | 0 | Bal. | 12 | 5 | 4 | 0.3 | 0.3 | 0 | 1.18 |
| 0.1 | 64 | Bal. | 5 | 0 | 0.2 | 0.3 | 0.3 | 0 | Bal. | 12 | 5 | 4 | 0.3 | 0.3 | 0 | 1.18 |

TABLE 3g-continued

| | Sample No. | Sintered Alloy Composition (wt %) First Phase Fe | W | V | Cr | Si | Mn | S | Second Phase Fe | W | V | Cr | Si | Mn | S | Total C |
|---|---|---|---|---|---|---|---|---|---|---|---|---|---|---|---|---|
| 0.2 | 65 | Bal. | 5 | 0 | 0.2 | 0.3 | 0.3 | 0 | Bal. | 12 | 5 | 4 | 0.3 | 0.3 | 0 | 1.18 |
| 0.3 | 66 | Bal. | 5 | 0 | 0.2 | 0.3 | 0.3 | 0 | Bal. | 12 | 5 | 4 | 0.3 | 0.3 | 0 | 1.18 |
| 0.5 | 67 | Bal. | 5 | 0 | 0.2 | 0.3 | 0.3 | 0 | Bal. | 12 | 5 | 4 | 0.3 | 0.3 | 0 | 1.18 |
| 1.0 | 68 | Bal. | 5 | 0 | 0.2 | 0.3 | 0.3 | 0 | Bal. | 12 | 5 | 4 | 0.3 | 0.3 | 0 | 1.18 |
| 1.2 | 69 | Bal. | 5 | 0 | 0.2 | 0.3 | 0.3 | 0 | Bal. | 12 | 5 | 4 | 0.3 | 0.3 | 0 | 1.18 |
| 1.6 | 70 | Bal. | 5 | 0 | 0.2 | 0.3 | 0.3 | 0 | Bal. | 12 | 5 | 4 | 0.3 | 0.3 | 0 | 1.18 |
| 2.5 | 71 | Bal. | 5 | 0 | 0.2 | 0.3 | 0.3 | 0 | Bal. | 12 | 5 | 4 | 0.3 | 0.3 | 0 | 1.18 |
| Added MnS Powder & Si in 1st and 2nd Phases (parts by wt.) | | | | | | | | | | | | | | | | |
| 0.3 | 4 | Bal. | 5 | 0 | 0.2 | 0.3 | 0.3 | 0 | Bal. | 12 | 5 | 4 | 0.3 | 0.3 | 0 | 1.18 |
| 2.5 | 72 | Bal. | 5 | 0 | 0.2 | 2 | 0.3 | 0 | Bal. | 12 | 5 | 4 | 2 | 0.3 | 0 | 1.18 |

TABLE 3h

| | Sample No. | Sintered Alloy Composition (wt %) First Phase Fe | W | V | Cr | Si | Mn | S | Second Phase Fe | W | V | Cr | Si | Mn | S | Total C |
|---|---|---|---|---|---|---|---|---|---|---|---|---|---|---|---|---|
| W cont. in 1st Phase (wt %) | | | | | | | | | | | | | | | | |
| 0 | 73 | Bal. | 0 | 1 | 0.2 | 0.3 | 0.3 | 0 | Bal. | 12 | 5 | 4 | 0.3 | 0.3 | 0 | 1.21 |
| 2 | 74 | Bal. | 2 | 1 | 0.2 | 0.3 | 0.3 | 0 | Bal. | 12 | 5 | 4 | 0.3 | 0.3 | 0 | 1.22 |
| 3 | 75 | Bal. | 3 | 1 | 0.2 | 0.3 | 0.3 | 0 | Bal. | 12 | 5 | 4 | 0.3 | 0.3 | 0 | 1.22 |
| 5 | 22 | Bal. | 5 | 1 | 0.2 | 0.3 | 0.3 | 0 | Bal. | 12 | 5 | 4 | 0.3 | 0.3 | 0 | 1.23 |
| 7 | 76 | Bal. | 7 | 1 | 0.2 | 0.3 | 0.3 | 0 | Bal. | 12 | 5 | 4 | 0.3 | 0.3 | 0 | 1.24 |
| 8 | 77 | Bal. | 8 | 1 | 0.2 | 0.3 | 0.3 | 0 | Bal. | 12 | 5 | 4 | 0.3 | 0.3 | 0 | 1.25 |
| 10 | 78 | Bal. | 10 | 1 | 0.2 | 0.3 | 0.3 | 0 | Bal. | 12 | 5 | 4 | 0.3 | 0.3 | 0 | 1.26 |
| W cont. in 2nd Phase (wt %) | | | | | | | | | | | | | | | | |
| 0 | 79 | Bal. | 5 | 1 | 0.2 | 0.3 | 0.3 | 0 | Bal. | 0 | 5 | 4 | 0.3 | 0.3 | 0 | 1.17 |
| 2 | 80 | Bal. | 5 | 1 | 0.2 | 0.3 | 0.3 | 0 | Bal. | 2 | 5 | 4 | 0.3 | 0.3 | 0 | 1.18 |
| 3 | 81 | Bal. | 5 | 1 | 0.2 | 0.3 | 0.3 | 0 | Bal. | 3 | 5 | 4 | 0.3 | 0.3 | 0 | 1.19 |
| 7 | 82 | Bal. | 5 | 1 | 0.2 | 0.3 | 0.3 | 0 | Bal. | 7 | 5 | 4 | 0.3 | 0.3 | 0 | 1.21 |
| 12 | 22 | Bal. | 5 | 1 | 0.2 | 0.3 | 0.3 | 0 | Bal. | 12 | 5 | 4 | 0.3 | 0.3 | 0 | 1.23 |
| 15 | 83 | Bal. | 5 | 1 | 0.2 | 0.3 | 0.3 | 0 | Bal. | 15 | 5 | 4 | 0.3 | 0.3 | 0 | 1.25 |
| 16 | 84 | Bal. | 5 | 1 | 0.2 | 0.3 | 0.3 | 0 | Bal. | 16 | 5 | 4 | 0.3 | 0.3 | 0 | 1.25 |
| 18 | 85 | Bal. | 5 | 1 | 0.2 | 0.3 | 0.3 | 0 | Bal. | 18 | 5 | 4 | 0.3 | 0.3 | 0 | 1.26 |

TABLE 3i

| | Sample No. | Sintered Alloy Composition (wt %) First Phase Fe | W | V | Cr | Si | Mn | S | Second Phase Fe | W | V | Cr | Si | Mn | S | Total C |
|---|---|---|---|---|---|---|---|---|---|---|---|---|---|---|---|---|
| V cont. in 2nd Phase (wt %) | | | | | | | | | | | | | | | | |
| 0 | 86 | Bal. | 5 | 1 | 0.2 | 0.3 | 0.3 | 0 | Bal. | 12 | 0 | 4 | 0.3 | 0.3 | 0 | 0.94 |
| 1 | 87 | Bal. | 5 | 1 | 0.2 | 0.3 | 0.3 | 0 | Bal. | 12 | 1 | 4 | 0.3 | 0.3 | 0 | 1.00 |
| 2 | 88 | Bal. | 5 | 1 | 0.2 | 0.3 | 0.3 | 0 | Bal. | 12 | 2 | 4 | 0.3 | 0.3 | 0 | 1.06 |
| 5 | 22 | Bal. | 5 | 1 | 0.2 | 0.3 | 0.3 | 0 | Bal. | 12 | 5 | 4 | 0.3 | 0.3 | 0 | 1.23 |
| 7 | 89 | Bal. | 5 | 1 | 0.2 | 0.3 | 0.3 | 0 | Bal. | 12 | 7 | 4 | 0.3 | 0.3 | 0 | 1.35 |
| 8 | 90 | Bal. | 5 | 1 | 0.2 | 0.3 | 0.3 | 0 | Bal. | 12 | 8 | 4 | 0.3 | 0.3 | 0 | 1.41 |
| 10 | 91 | Bal. | 5 | 1 | 0.2 | 0.3 | 0.3 | 0 | Bal. | 12 | 10 | 4 | 0.3 | 0.3 | 0 | 1.52 |
| Cr cont. in 2nd Phase (wt %) | | | | | | | | | | | | | | | | |
| 0 | 92 | Bal. | 5 | 1 | 0 | 0.3 | 0.3 | 0 | Bal. | 12 | 5 | 0 | 0.3 | 0.3 | 0 | 1.23 |

TABLE 3i-continued

| | Sample No. | Sintered Alloy Composition (wt %) First Phase Fe | W | V | Cr | Si | Mn | S | Second Phase Fe | W | V | Cr | Si | Mn | S | Total C |
|---|---|---|---|---|---|---|---|---|---|---|---|---|---|---|---|---|
| 1 | 93 | Bal. | 5 | 1 | 0.05 | 0.3 | 0.3 | 0 | Bal. | 12 | 5 | 1 | 0.3 | 0.3 | 0 | 1.23 |
| 2 | 94 | Bal. | 5 | 1 | 0.1 | 0.3 | 0.3 | 0 | Bal. | 12 | 5 | 2 | 0.3 | 0.3 | 0 | 1.23 |
| 4 | 22 | Bal. | 5 | 1 | 0.2 | 0.3 | 0.3 | 0 | Bal. | 12 | 5 | 4 | 0.3 | 0.3 | 0 | 1.23 |
| 7 | 95 | Bal. | 5 | 1 | 0.35 | 0.3 | 0.3 | 0 | Bal. | 12 | 5 | 7 | 0.3 | 0.3 | 0 | 1.23 |
| 8 | 96 | Bal. | 5 | 1 | 0.4 | 0.3 | 0.3 | 0 | Bal. | 12 | 5 | 8 | 0.3 | 0.3 | 0 | 1.23 |
| 10 | 97 | Bal. | 5 | 1 | 0.5 | 0.3 | 0.3 | 0 | Bal. | 12 | 5 | 10 | 0.3 | 0.3 | 0 | 1.23 |

TABLE 3j

| | Sample No. | Sintered Alloy Composition (wt %) First Phase Fe | W | V | Cr | Si | Mn | S | Second Phase Fe | W | V | Cr | Si | Mn | S | Total C |
|---|---|---|---|---|---|---|---|---|---|---|---|---|---|---|---|---|
| Cr cont. in 1st Phase (wt %) | | | | | | | | | | | | | | | | |
| 0.2 | 22 | Bal. | 5 | 1 | 0.2 | 0.3 | 0.3 | 0 | Bal. | 12 | 5 | 4 | 0.3 | 0.3 | 0 | 1.23 |
| 1 | 98 | Bal. | 5 | 1 | 1 | 0.3 | 0.3 | 0 | Bal. | 12 | 5 | 4 | 0.3 | 0.3 | 0 | 1.23 |
| 1.5 | 99 | Bal. | 5 | 1 | 1.5 | 0.3 | 0.3 | 0 | Bal. | 12 | 5 | 4 | 0.3 | 0.3 | 0 | 1.23 |
| 4 | 100 | Bal. | 5 | 1 | 4 | 0.3 | 0.3 | 0 | Bal. | 12 | 5 | 4 | 0.3 | 0.3 | 0 | 1.23 |
| 4 | 101 | Bal. | 5 | 1 | 4 | 0.3 | 0.3 | 0 | Bal. | 12 | 5 | 0 | 0.3 | 0.3 | 0 | 1.23 |
| Ratio of 1st Phase to 2nd Phase by wt. | | | | | | | | | | | | | | | | |
| 100:0 | 102 | Bal. | 5 | 1 | 0.2 | 0.3 | 0.3 | 0 | Bal. | 12 | 5 | 4 | 0.3 | 0.3 | 0 | 0.97 |
| 90:10 | 103 | Bal. | 5 | 1 | 0.2 | 0.3 | 0.3 | 0 | Bal. | 12 | 5 | 4 | 0.3 | 0.3 | 0 | 1.02 |
| 80:20 | 104 | Bal. | 5 | 1 | 0.2 | 0.3 | 0.3 | 0 | Bal. | 12 | 5 | 4 | 0.3 | 0.3 | 0 | 1.07 |
| 50:50 | 22 | Bal. | 5 | 1 | 0.2 | 0.3 | 0.3 | 0 | Bal. | 12 | 5 | 4 | 0.3 | 0.3 | 0 | 1.23 |
| 20:80 | 105 | Bal. | 5 | 1 | 0.2 | 0.3 | 0.3 | 0 | Bal. | 12 | 5 | 4 | 0.3 | 0.3 | 0 | 1.39 |
| 10:90 | 106 | Bal. | 5 | 1 | 0.2 | 0.3 | 0.3 | 0 | Bal. | 12 | 5 | 4 | 0.3 | 0.3 | 0 | 1.45 |
| 0:100 | 107 | Bal. | 5 | 1 | 0.2 | 0.3 | 0.3 | 0 | Bal. | 12 | 5 | 4 | 0.3 | 0.3 | 0 | 1.50 |

TABLE 3k

| | Sample No. | Sintered Alloy Composition (wt %) First Phase Fe | W | V | Cr | Si | Mn | S | Second Phase Fe | W | V | Cr | Si | Mn | S | C |
|---|---|---|---|---|---|---|---|---|---|---|---|---|---|---|---|---|
| Si cont. in 1st or 2nd Phase (wt %) | | | | | | | | | | | | | | | | |
| 0.05 | 108 | Bal. | 5 | 1 | 0.2 | 0.05 | 0.3 | 0 | Bal. | 12 | 5 | 4 | 0.05 | 0.3 | 0 | 1.23 |
| 0.1 | 109 | Bal. | 5 | 1 | 0.2 | 0.1 | 0.3 | 0 | Bal. | 12 | 5 | 4 | 0.1 | 0.3 | 0 | 1.23 |
| 0.3 | 22 | Bal. | 5 | 1 | 0.2 | 0.3 | 0.3 | 0 | Bal. | 12 | 5 | 4 | 0.3 | 0.3 | 0 | 1.23 |
| 0.6 | 110 | Bal. | 5 | 1 | 0.2 | 0.6 | 0.3 | 0 | Bal. | 12 | 5 | 4 | 0.6 | 0.3 | 0 | 1.23 |
| 0.7 | 111 | Bal. | 5 | 1 | 0.2 | 0.7 | 0.3 | 0 | Bal. | 12 | 5 | 4 | 0.7 | 0.3 | 0 | 1.23 |
| 2 | 112 | Bal. | 5 | 1 | 0.2 | 2 | 0.3 | 0 | Bal. | 12 | 5 | 4 | 2 | 0.3 | 0 | 1.23 |
| 5 | 113 | Bal. | 5 | 1 | 0.2 | 5 | 0.3 | 0 | Bal. | 12 | 5 | 4 | 5 | 0.3 | 0 | 1.23 |
| 7 | 114 | Bal. | 5 | 1 | 0.2 | 7 | 0.3 | 0 | Bal. | 12 | 5 | 4 | 7 | 0.3 | 0 | 1.23 |
| Mn cont. in 1st or 2nd Phase (wt %) | | | | | | | | | | | | | | | | |
| 0.05 | 115 | Bal. | 5 | 1 | 0.2 | 0.3 | 0.05 | 0 | Bal. | 12 | 5 | 4 | 0.3 | 0.05 | 0 | 1.23 |
| 0.1 | 116 | Bal. | 5 | 1 | 0.2 | 0.3 | 0.1 | 0 | Bal. | 12 | 5 | 4 | 0.3 | 0.1 | 0 | 1.23 |
| 0.2 | 117 | Bal. | 5 | 1 | 0.2 | 0.3 | 0.2 | 0 | Bal. | 12 | 5 | 4 | 0.3 | 0.2 | 0 | 1.23 |
| 0.3 | 22 | Bal. | 5 | 1 | 0.2 | 0.3 | 0.3 | 0 | Bal. | 12 | 5 | 4 | 0.3 | 0.3 | 0 | 1.23 |
| 0.6 | 118 | Bal. | 5 | 1 | 0.2 | 0.3 | 0.6 | 0 | Bal. | 12 | 5 | 4 | 0.3 | 0.6 | 0 | 1.23 |
| 0.7 | 119 | BaI. | 5 | 1 | 0.2 | 0.3 | 0.7 | 0 | Bal. | 12 | 5 | 4 | 0.3 | 0.7 | 0 | 1.23 |
| 1 | 120 | Bal. | 5 | 1 | 0.2 | 0.3 | 1 | 0 | Bal. | 12 | 5 | 4 | 0.3 | 1 | 0 | 1.23 |

TABLE 3l

| | Sample No. | Sintered Alloy Composition (wt %) First Phase Fe | W | V | Cr | Si | Mn | S | Second Phase Fe | W | V | Cr | Si | Mn | S | C |
|---|---|---|---|---|---|---|---|---|---|---|---|---|---|---|---|---|
| Precipitated MnS cont. in 1st or 2nd Phase (wt %) | | | | | | | | | | | | | | | | |
| 0.08 | 121 | Bal. | 5 | 1 | 0.2 | 0.3 | 0.05 | 0.03 | Bal. | 12 | 5 | 4 | 0.3 | 0.05 | 0.03 | 1.23 |
| 0.17 | 122 | Bal. | 5 | 1 | 0.2 | 0.3 | 0.1 | 0.07 | Bal. | 12 | 5 | 4 | 0.3 | 0.1 | 0.07 | 1.23 |
| 0.33 | 123 | Bal. | 5 | 1 | 0.2 | 0.3 | 0.2 | 0.13 | Bal. | 12 | 5 | 4 | 0.3 | 0.2 | 0.13 | 1.23 |
| 0.5 | 124 | Bal. | 5 | 1 | 0.2 | 0.3 | 0.3 | 0.2 | Bal. | 12 | 5 | 4 | 0.3 | 0.3 | 0.2 | 1.23 |
| 1 | 125 | Bal. | 5 | 1 | 0.2 | 0.3 | 0.6 | 0.4 | Bal. | 12 | 5 | 4 | 0.3 | 0.6 | 0.4 | 1.23 |
| 1.17 | 126 | Bal. | 5 | 1 | 0.2 | 0.3 | 0.7 | 0.47 | Bal. | 12 | 5 | 4 | 0.3 | 0.7 | 0.47 | 1.23 |
| 1.67 | 127 | Bal. | 5 | 1 | 0.2 | 0.3 | 1 | 0.67 | Bal. | 12 | 5 | 4 | 0.3 | 1 | 0.67 | 1.23 |
| 2.5 | 128 | Bal. | 5 | 1 | 0.2 | 0.3 | 1.5 | 1 | Bal. | 12 | 5 | 4 | 0.3 | 1.5 | 1 | 1.23 |
| (Precipitated MnS + Si) cont. in 1st or 2nd Phase (wt %) | | | | | | | | | | | | | | | | |
| 0.3 | 22 | Bal. | 5 | 1 | 0.2 | 0.3 | 0.3 | 0 | Bal. | 12 | 5 | 4 | 0.3 | 0.3 | 0 | 1.23 |
| 2.5 | 129 | Bal. | 5 | 1 | 0.2 | 2 | 0.3 | 0.2 | Bal. | 12 | 5 | 4 | 2 | 0.3 | 0.2 | 1.23 |

TABLE 3m

| | Sample No. | Sintered Alloy Composition (wt %) First Phase Fe | W | V | Cr | Si | Mn | S | Second Phase Fe | W | V | Cr | Si | Mn | S | C |
|---|---|---|---|---|---|---|---|---|---|---|---|---|---|---|---|---|
| Added MnS Powder (parts by weight) | | | | | | | | | | | | | | | | |
| 0 | 22 | Bal. | 5 | 1 | 0.2 | 0.3 | 0.3 | 0 | Bal. | 12 | 5 | 4 | 0.3 | 0.3 | 0 | 1.23 |
| 0.1 | 130 | Bal. | 5 | 1 | 0.2 | 0.3 | 0.3 | 0 | Bal. | 12 | 5 | 4 | 0.3 | 0.3 | 0 | 1.23 |
| 0.2 | 131 | Bal. | 5 | 1 | 0.2 | 0.3 | 0.3 | 0 | Bal. | 12 | 5 | 4 | 0.3 | 0.3 | 0 | 1.23 |
| 0.3 | 132 | Bal. | 5 | 1 | 0.2 | 0.3 | 0.3 | 0 | Bal. | 12 | 5 | 4 | 0.3 | 0.3 | 0 | 1.23 |
| 0.5 | 133 | Bal. | 5 | 1 | 0.2 | 0.3 | 0.3 | 0 | Bal. | 12 | 5 | 4 | 0.3 | 0.3 | 0 | 1.23 |
| 1.0 | 134 | Bal. | 5 | 1 | 0.2 | 0.3 | 0.3 | 0 | Bal. | 12 | 5 | 4 | 0.3 | 0.3 | 0 | 1.23 |
| 1.2 | 135 | Bal. | 5 | 1 | 0.2 | 0.3 | 0.3 | 0 | Bal. | 12 | 5 | 4 | 0.3 | 0.3 | 0 | 1.23 |
| 1.6 | 136 | Bal. | 5 | 1 | 0.2 | 0.3 | 0.3 | 0 | Bal. | 12 | 5 | 4 | 0.3 | 0.3 | 0 | 1.23 |
| 2.5 | 137 | Bal. | 5 | 1 | 0.2 | 0.3 | 0.3 | 0 | Bal. | 12 | 5 | 4 | 0.3 | 0.3 | 0 | 1.23 |
| Added MnS Powder & Si in 1st and 2nd Phases (parts by wt.) | | | | | | | | | | | | | | | | |
| 0.3 | 22 | Bal. | 5 | 1 | 0.2 | 0.3 | 0.3 | 0 | Bal. | 12 | 5 | 4 | 0.3 | 0.3 | 0 | 1.23 |
| 2.5 | 138 | Bal. | 5 | 1 | 0.2 | 2 | 0.3 | 0 | Bal. | 12 | 5 | 4 | 2 | 0.3 | 0 | 1.23 |

TABLE 4a

| | Sample No. | 1st Phase (wt %) | 2nd Phase (wt %) | Wear in Unleaded Gasoline Test (μm) Valve Seat Insert | Valve | Total |
|---|---|---|---|---|---|---|
| W cont. in 1st Phase (wt %) | | | | | | |
| 0 | 1 | 50 | 50 | 130 | 5 | 135 |
| 2 | 2 | 50 | 50 | 80 | 25 | 105 |
| 3 | 3 | 50 | 50 | 60 | 20 | 80 |
| 5 | 4 | 50 | 50 | 40 | 24 | 64 |
| 7 | 5 | 50 | 50 | 70 | 28 | 98 |
| 8 | 6 | 50 | 50 | 78 | 36 | 114 |

TABLE 4a-continued

| | Sample No. | 1st Phase (wt %) | 2nd Phase (wt %) | Wear in Unleaded Gasoline Test (μm) Valve Seat Insert | Valve | Total |
|---|---|---|---|---|---|---|
| 10 | 7 | 50 | 50 | 95 | 55 | 150 |
| W cont. in 2nd Phase (wt %) | | | | | | |
| 0 | 8 | 50 | 50 | 120 | 5 | 125 |
| 2 | 9 | 50 | 50 | 96 | 29 | 125 |
| 3 | 10 | 50 | 50 | 82 | 11 | 93 |
| 7 | 11 | 50 | 50 | 45 | 18 | 63 |
| 12 | 4 | 50 | 50 | 40 | 24 | 64 |
| 15 | 12 | 50 | 50 | 67 | 28 | 95 |
| 16 | 13 | 50 | 50 | 79 | 44 | 123 |
| 18 | 14 | 50 | 50 | 88 | 76 | 164 |

TABLE 4b

| | Sample No. | 1st Phase (wt %) | 2nd Phase (wt %) | Wear in Unleaded Gasoline Test (μm) Valve Seat Insert | Valve | Total | Wear in Leaded Gasoline Test (μm) Valve Seat Insert | Valve | Total |
|---|---|---|---|---|---|---|---|---|---|
| V cont. in 2nd Phase (wt %) | | | | | | | | | |
| 0 | 15 | 50 | 50 | 244 | 2 | 246 | — | — | — |
| 1 | 16 | 50 | 50 | 125 | 5 | 130 | — | — | — |
| 2 | 17 | 50 | 50 | 67 | 11 | 78 | — | — | — |
| 5 | 4 | 50 | 50 | 40 | 24 | 64 | — | — | — |
| 7 | 18 | 50 | 50 | 33 | 56 | 89 | — | — | — |
| 8 | 19 | 50 | 50 | 58 | 89 | 147 | — | — | — |
| 10 | 20 | 50 | 50 | 98 | 148 | 246 | — | — | — |
| V cont. in 1st Phase (wt %) | | | | | | | | | |
| 0 | 4 | 50 | 50 | 40 | 24 | 64 | 58 | 38 | 96 |
| 0.5 | 21 | 50 | 50 | 45 | 28 | 73 | 38 | 25 | 63 |
| 1 | 22 | 50 | 50 | 55 | 31 | 86 | 14 | 28 | 42 |
| 1.5 | 23 | 50 | 50 | 59 | 35 | 94 | 28 | 35 | 63 |
| 2 | 24 | 50 | 50 | 68 | 58 | 126 | 55 | 48 | 103 |
| 5 | 25 | 50 | 50 | 210 | 268 | 478 | 87 | 102 | 189 |

TABLE 4c

| | Sample No. | 1st Phase (wt %) | 2nd Phase (wt %) | Wear in Unleaded Gasoline Test (μm) Valve Seat Insert | Valve | Total |
|---|---|---|---|---|---|---|
| Cr cont. in 2nd Phase (wt %) | | | | | | |
| 0 | 26 | 50 | 50 | 140 | 32 | 172 |
| 1 | 27 | 50 | 50 | 97 | 28 | 125 |
| 2 | 28 | 50 | 50 | 58 | 18 | 76 |
| 4 | 4 | 50 | 50 | 40 | 24 | 64 |
| 7 | 29 | 50 | 50 | 35 | 38 | 73 |
| 8 | 30 | 50 | 50 | 55 | 59 | 114 |
| 10 | 31 | 50 | 50 | 89 | 78 | 167 |
| Cr cont. in 1st Phase (wt %) | | | | | | |
| 0 | 4 | 50 | 50 | 40 | 24 | 64 |
| 0.9 | 32 | 50 | 50 | 55 | 35 | 90 |
| 1.4 | 33 | 50 | 50 | 88 | 33 | 121 |
| 4 | 34 | 50 | 50 | 245 | 167 | 412 |
| 4 | 35 | 50 | 50 | 125 | 43 | 168 |

TABLE 4d

| | | Wear in Unleaded Gasoline Test (μm) | | | Wear in Leaded Gasoline Test (μm) | | |
|---|---|---|---|---|---|---|---|
| | Sample No. | Valve Seat Insert | Valve | Total | Valve Seat Insert | Valve | Total |
| Ratio of 1st Phase to 2nd Phase by wt. | | | | | | | |
| 100:0 | 36 | 342 | 4 | 346 | — | — | — |
| 90:10 | 37 | 266 | 4 | 270 | — | — | — |
| 80:20 | 38 | 89 | 8 | 97 | — | — | — |
| 50:50 | 4 | 40 | 24 | 64 | — | — | — |
| 20:80 | 39 | 25 | 37 | 62 | — | — | — |
| 10:90 | 40 | 58 | 89 | 147 | — | — | — |
| 0:100 | 41 | 89 | 177 | 266 | — | — | — |
| | Com. Sample A | 102 | 5 | 107 | 88 | 12 | 100 |

TABLE 4e

| | | | | Wear in Leaded Gasoline Test (μm) | | |
|---|---|---|---|---|---|---|
| | Sample No. | 1st Phase (wt %) | 2nd Phase (wt %) | Valve Seat Insert | Valve | Total |
| W cont. in 1st Phase (wt %) | | | | | | |
| 0 | 73 | 50 | 50 | 120 | 10 | 130 |
| 2 | 74 | 50 | 50 | 93 | 18 | 111 |
| 3 | 75 | 50 | 50 | 28 | 25 | 53 |
| 5 | 22 | 50 | 50 | 14 | 28 | 42 |
| 7 | 76 | 50 | 50 | 33 | 46 | 79 |
| 8 | 77 | 50 | 50 | 58 | 78 | 136 |
| 10 | 78 | 50 | 50 | 68 | 98 | 166 |
| W cont. in 2nd Phase (wt %) | | | | | | |
| 0 | 79 | 50 | 50 | 119 | 12 | 131 |
| 2 | 80 | 50 | 50 | 98 | 13 | 111 |
| 3 | 81 | 50 | 50 | 59 | 11 | 70 |
| 7 | 82 | 50 | 50 | 36 | 12 | 48 |
| 12 | 22 | 50 | 50 | 14 | 28 | 42 |
| 15 | 83 | 50 | 50 | 56 | 33 | 89 |
| 16 | 84 | 50 | 50 | 89 | 56 | 145 |
| 18 | 85 | 50 | 50 | 98 | 60 | 158 |

TABLE 4f

| | | | | Wear in Leaded Gasoline Test (μm) | | |
|---|---|---|---|---|---|---|
| | Sample No. | 1st Phase (wt %) | 2nd Phase (wt %) | Valve Seat Insert | Valve | Total |
| V cont. in 2nd Phase (wt %) | | | | | | |
| 0 | 86 | 50 | 50 | 380 | 5 | 385 |
| 1 | 87 | 50 | 50 | 245 | 7 | 252 |
| 2 | 88 | 50 | 50 | 68 | 10 | 78 |
| 5 | 22 | 50 | 50 | 14 | 28 | 42 |
| 7 | 89 | 50 | 50 | 23 | 48 | 71 |
| 8 | 90 | 50 | 50 | 54 | 76 | 130 |
| 10 | 91 | 50 | 50 | 89 | 98 | 187 |
| Cr cont. in 2nd Phase (wt %) | | | | | | |
| 0 | 92 | 50 | 50 | 130 | 45 | 175 |
| 1 | 93 | 50 | 50 | 88 | 44 | 132 |
| 2 | 94 | 50 | 50 | 60 | 39 | 99 |
| 4 | 22 | 50 | 50 | 14 | 28 | 42 |

TABLE 4f-continued

| | Sample No. | 1st Phase (wt %) | 2nd Phase (wt %) | Wear in Leaded Gasoline Test (μm) Valve Seat Insert | Valve | Total |
|---|---|---|---|---|---|---|
| 7 | 95 | 50 | 50 | 15 | 25 | 40 |
| 8 | 96 | 50 | 50 | 78 | 40 | 118 |
| 10 | 97 | 50 | 50 | 98 | 65 | 163 |

TABLE 4g

| | Sample No. | 1st Phase (wt %) | 2nd Phase (wt %) | Wear in Leaded Gasoline Test (μm) Valve Seat Insert | Valve | Total |
|---|---|---|---|---|---|---|
| Cr cont. in 1st Phase (wt %) | | | | | | |
| 0.2 | 22 | 50 | 50 | 14 | 28 | 42 |
| 1 | 98 | 50 | 50 | 38 | 36 | 74 |
| 1.5 | 99 | 50 | 50 | 67 | 30 | 97 |
| 4 | 100 | 50 | 50 | 230 | 145 | 375 |
| 4 | 101 | 50 | 50 | 276 | 89 | 365 |
| Ratio of 1st Phase to 2nd Phase by wt. | | | | | | |
| 100:0 | 102 | 100 | 0 | 246 | 1 | 247 |
| 90:10 | 103 | 90 | 10 | 233 | 2 | 235 |
| 80:20 | 104 | 80 | 20 | 78 | 5 | 83 |
| 50:50 | 22 | 50 | 50 | 14 | 28 | 42 |
| 20:80 | 105 | 20 | 80 | 26 | 40 | 66 |
| 10:90 | 106 | 10 | 90 | 68 | 76 | 144 |
| 0:100 | 107 | 0 | 100 | 78 | 167 | 245 |

TABLE 5a

| | Sample No. | 1st Phase (wt %) | 2nd Phase (wt %) | Wear in Leaded Gasoline Test (μm) Valve Seat Insert | Valve | Total | Radial Crushing Strength (MPa) |
|---|---|---|---|---|---|---|---|
| Si cont. in 1st or 2nd Phase (wt %) | | | | | | | |
| 0.05 | 42 | 50 | 50 | 450 | 50 | 500 | 289 |
| 0.1 | 43 | 50 | 50 | 59 | 40 | 99 | 832 |
| 0.3 | 4 | 50 | 50 | 58 | 38 | 96 | 935 |
| 0.6 | 44 | 50 | 50 | 48 | 36 | 84 | 837 |
| 0.7 | 45 | 50 | 50 | 29 | 20 | 49 | 725 |
| 2 | 46 | 50 | 50 | 35 | 18 | 53 | 610 |
| 5 | 47 | 50 | 50 | 37 | 15 | 52 | 588 |
| 7 | 48 | 50 | 50 | 268 | 58 | 326 | 345 |
| Mn cont. in 1st or 2nd Phase (wt %) | | | | | | | |
| 0.05 | 49 | 50 | 50 | | | | 600 |
| 0.1 | 50 | 50 | 50 | | | | 788 |
| 0.2 | 51 | 50 | 50 | | | | 896 |
| 0.3 | 4 | 50 | 50 | | | | 935 |
| 0.6 | 52 | 50 | 50 | | | | 799 |
| 0.7 | 53 | 50 | 50 | | | | 488 |
| 1 | 54 | 50 | 50 | | | | 321 |

TABLE 5b

| | Sample No. | 1st Phase (wt %) | 2nd Phase (wt %) | Wear in Leaded Gasoline Test (μm) Valve Seat Insert | Valve | Total | Radial Crushing Strength (MPa) | Compact Density (g/cm$^3$) | Max. Cutting Force (kgf) |
|---|---|---|---|---|---|---|---|---|---|
| Precipitated MnS cont. in 1st or 2nd Phase (wt %) | | | | | | | | | |
| 0.08 | 55 | 50 | 50 | | | | 911 | 6.88 | 78 |
| 0.17 | 56 | 50 | 50 | | | | 898 | 6.87 | 68 |
| 0.33 | 57 | 50 | 50 | | | | 862 | 6.85 | 54 |
| 0.5 | 58 | 50 | 50 | | | | 832 | 6.84 | 51 |
| 1 | 59 | 50 | 50 | | | | 788 | 6.8 | 48 |
| 1.17 | 60 | 50 | 50 | | | | 725 | 6.78 | 44 |
| 1.67 | 61 | 50 | 50 | | | | 675 | 6.76 | 41 |
| 2.5 | 62 | 50 | 50 | | | | 331 | 6.51 | 38 |
| (Precipitated MnS + Si) cont. in 1st or 2nd Phase (wt %) | | | | | | | | | |
| 0.3 | 4 | 50 | 50 | 58 | 38 | 96 | | | 81 |
| 2.5 | 63 | 50 | 50 | 35 | 18 | 53 | | | 53 |

TABLE 5c

| | Sample No. | 1st Phase (wt %) | 2nd Phase (wt %) | Wear in Leaded Gasoline Test (μm) Valve Seat Insert | Valve | Total | Radial Crushing Strength (MPa) | Compact Density (g/cm$^3$) | Max. Cutting Force (kgf) |
|---|---|---|---|---|---|---|---|---|---|
| Added MnS Powder (parts by weight) | | | | | | | | | |
| 0 | 4 | 50 | 50 | | | | 935 | 6.90 | 81 |
| 0.1 | 64 | 50 | 50 | | | | 920 | 6.87 | 80 |
| 0.2 | 65 | 50 | 50 | | | | 901 | 6.87 | 72 |
| 0.3 | 66 | 50 | 50 | | | | 868 | 6.86 | 57 |
| 0.5 | 67 | 50 | 50 | | | | 833 | 6.84 | 54 |
| 1.0 | 68 | 50 | 50 | | | | 790 | 6.81 | 53 |
| 1.2 | 69 | 50 | 50 | | | | 720 | 6.79 | 49 |
| 1.6 | 70 | 50 | 50 | | | | 671 | 6.75 | 43 |
| 2.5 | 71 | 50 | 50 | | | | 350 | 6.52 | 40 |
| Added MnS Powder & Si in 1st and 2nd Phases (parts by wt.) | | | | | | | | | |
| 0.3 | 4 | 50 | 50 | 58 | 38 | 96 | | | 81 |
| 2.5 | 72 | 50 | 50 | 38 | 15 | 53 | | | 55 |

TABLE 5d

| | Sample No. | 1st Phase (wt %) | 2nd Phase (wt %) | Wear in Leaded Gasoline Test (μm) Valve Seat Insert | Valve | Total | Radial Crushing Strength (MPa) |
|---|---|---|---|---|---|---|---|
| Si cont. in 1st or 2nd Phase (wt %) | | | | | | | |
| 0.05 | 108 | 50 | 50 | 450 | 50 | 500 | 279 |
| 0.1 | 109 | 50 | 50 | 59 | 31 | 90 | 821 |
| 0.3 | 22 | 50 | 50 | 19 | 28 | 47 | 904 |
| 0.6 | 110 | 50 | 50 | 18 | 20 | 38 | 817 |
| 0.7 | 111 | 50 | 50 | 15 | 20 | 35 | 720 |
| 2 | 112 | 50 | 50 | 10 | 16 | 26 | 605 |
| 5 | 113 | 50 | 50 | 37 | 15 | 52 | 570 |
| 7 | 114 | 50 | 50 | 268 | 58 | 326 | 330 |

TABLE 5d-continued

| | Sample No. | 1st Phase (wt %) | 2nd Phase (wt %) | Wear in Leaded Gasoline Test (μm) Valve Seat Insert | Valve | Total | Radial Crushing Strength (MPa) |
|---|---|---|---|---|---|---|---|
| Mn cont. in 1st or 2nd Phase (wt %) | | | | | | | |
| 0.05 | 115 | 50 | 50 | | | | 404 |
| 0.1 | 116 | 50 | 50 | | | | 778 |
| 0.2 | 117 | 50 | 50 | | | | 878 |
| 0.3 | 22 | 50 | 50 | | | | 904 |
| 0.6 | 118 | 50 | 50 | | | | 712 |
| 0.7 | 119 | 50 | 50 | | | | 468 |
| 1 | 120 | 50 | 50 | | | | 302 |

TABLE 5e

| | Sample No. | 1st Phase (wt %) | 2nd Phase (wt %) | Wear in Leaded Gasoline Test (μm) Valve Seat Insert | Valve | Total | Radial Crushing Strength (MPa) | Compact Density (g/cm$^3$) | Max. Cutting Force (kgf) |
|---|---|---|---|---|---|---|---|---|---|
| Precipitated MnS cont. in 1st or 2nd Phase (wt %) | | | | | | | | | |
| 0.08 | 121 | 50 | 50 | | | | 902 | 6.77 | 85 |
| 0.17 | 122 | 50 | 50 | | | | 882 | 6.75 | 72 |
| 0.33 | 123 | 50 | 50 | | | | 850 | 6.74 | 60 |
| 0.5 | 124 | 50 | 50 | | | | 802 | 6.73 | 58 |
| 1 | 125 | 50 | 50 | | | | 761 | 6.69 | 57 |
| 1.17 | 126 | 50 | 50 | | | | 708 | 6.66 | 56 |
| 1.67 | 127 | 50 | 50 | | | | 666 | 6.64 | 51 |
| 2.5 | 128 | 50 | 50 | | | | 311 | 6.42 | 48 |
| (Precipitated MnS + Si) cont. in 1st or 2nd Phase (wt %) | | | | | | | | | |
| 0.3 | 22 | 50 | 50 | 14 | 28 | 42 | | | 87 |
| 2.5 | 129 | 50 | 50 | 8 | 18 | 26 | | | 60 |

TABLE 5f

| | Sample No. | 1st Phase (wt %) | 2nd Phase (wt %) | Wear in Leaded Gasoline Test (μm) Valve Seat Insert | Valve | Total | Radial Crushing Strength (MPa) | Compact Density (g/cm$^3$) | Max. Cutting Force (kgf) |
|---|---|---|---|---|---|---|---|---|---|
| Added MnS Powder (parts by weight) | | | | | | | | | |
| 0 | 22 | 50 | 50 | | | | 904 | 6.80 | 87 |
| 0.1 | 130 | 50 | 50 | | | | 903 | 6.78 | 86 |
| 0.2 | 131 | 50 | 50 | | | | 880 | 6.76 | 73 |
| 0.3 | 132 | 50 | 50 | | | | 852 | 6.75 | 58 |
| 0.5 | 133 | 50 | 50 | | | | 799 | 6.73 | 57 |
| 1.0 | 134 | 50 | 50 | | | | 759 | 6.70 | 57 |
| 1.2 | 135 | 50 | 50 | | | | 712 | 6.65 | 55 |
| 1.6 | 136 | 50 | 50 | | | | 660 | 6.63 | 52 |
| 2.5 | 137 | 50 | 50 | | | | 315 | 6.41 | 50 |
| Added MnS Powder & Si in 1st and 2nd Phases (parts by wt.) | | | | | | | | | |
| 0.3 | 22 | 50 | 50 | 14 | 28 | 42 | | | 87 |
| 2.5 | 138 | 50 | 50 | 7 | 13 | 20 | | | 62 |

TABLE 6

| Sample No. | Wear in Unleaded Gasoline Test (μm) Valve Seat Insert | Valve | Total | Wear in Leaded Gasoline Test (μm) Valve Seat Insert | Valve | Total | Max. Cutting Force (kgf) |
|---|---|---|---|---|---|---|---|
| 4 | 40 | 24 | 64 | 58 | 38 | 96 | 81 |
| 4-Cu | 30 | 20 | 50 | 28 | 17 | 45 | — |
| 4-Pb | 25 | 10 | 35 | 60 | 10 | 70 | 38 |
| 4-Resin | — | — | — | — | — | — | 32 |
| 22 | 55 | 31 | 86 | 14 | 28 | 42 | 83 |
| 22-Cu | 35 | 28 | 63 | 8 | 16 | 24 | — |
| 22-Pb | 28 | 11 | 39 | 14 | 5 | 19 | 41 |
| 22-Resin | — | — | — | — | — | — | 38 |
| 58 | 38 | 21 | 59 | 56 | 33 | 89 | 51 |
| 58-Cu | 31 | 19 | 50 | 27 | 17 | 44 | — |
| 58-Pb | 27 | 8 | 35 | 70 | 11 | 81 | 25 |
| 58-Resin | — | — | — | — | — | — | 22 |
| 124 | 52 | 28 | 80 | 16 | 21 | 37 | 58 |
| 124-Cu | 34 | 21 | 55 | 10 | 13 | 23 | — |
| 124-Pb | 30 | 17 | 47 | 16 | 7 | 23 | 26 |
| 124-Resin | — | — | — | — | — | — | 23 |
| 46 | | | | 35 | 18 | 53 | 82 |
| 46-Cu | | | | 25 | 14 | 39 | — |
| 46-Pb | | | | 37 | 10 | 47 | 38 |
| 46-Resin | | | | — | — | — | 33 |
| 112 | | | | 10 | 16 | 26 | 85 |
| 112-Cu | | | | 5 | 4 | 9 | — |
| 112-Pb | | | | 11 | 2 | 13 | 40 |
| 112-Resin | | | | — | — | — | 37 |
| 63 | | | | 35 | 18 | 53 | 53 |
| 63-Cu | | | | 24 | 14 | 38 | — |
| 63-Pb | | | | 36 | 8 | 44 | 27 |
| 63-Resin | | | | — | — | — | 24 |
| 129 | | | | 8 | 18 | 26 | 60 |
| 129-Cu | | | | 4 | 5 | 9 | — |
| 129-Pb | | | | 10 | 2 | 12 | 28 |
| 129-Resin | | | | — | — | — | 25 |

The entire disclosure of each of Japanese Patent Application No. 8-92752 filed on Apr. 15, 1996 and Japanese Patent Application No. 9-57943 filed on Mar. 12, 1997, including specification, claims, drawings and summary, is incorporated herein by reference in its entirety.

What is claimed is:

1. A high-temperature wear-resistant sintered alloy comprising, based on a total weight of said sintered alloy, 3–13.4 wt % of W, 0.4–5.6 wt % of V, 0.2–5.6 wt % of Cr, 0.1–0.6 wt % of Si, 0.1–0.6 wt % of Mn, 0.6–2.2 wt % of C, and a balance of Fe, said sintered alloy including:

a first phase comprising, based on a total weight of said first phase, 3–7 wt % of W, up to 1 wt % of Cr, 0.1–0.6 wt % of Si, 0.1–0.6 wt % of Mn, up to 2.2 wt % of C, and a balance of Fe; and a second phase comprising, based on a total weight of said second phase, 3–15 wt % of W, 2–7 wt % of V, 1–7 wt % of Cr, 0.1–0.6 wt % of Si, 0.1–0.6 wt % of Mn, up to 2.2 wt % of C, and a balance of Fe, said second phase being in an amount of from 20 to 80 wt %, based on a total weight of said first and second phases, wherein said first and second phases are distributed in said sintered alloy, in a form of spots.

2. A high-temperature wear-resistant sintered alloy comprising, based on a total weight of said sintered alloy, 3–13.4 wt % of W, 0.8–5.9 wt % of V, 0.2–5.6 wt % of Cr, 0.1–0.6 wt % of Si, 0.1–0.6 wt % of Mn, 0.6–2.2 wt % of C, and a balance of Fe, said sintered alloy including:

a first phase comprising, based on a total weight of said first phase, 3–7 wt % of W, 0.5–1.5 wt % of V, up to 1 wt % of Cr, 0.1–0.6 wt % of Si, 0.1–0.6 wt % of Mn, up to 2.2 wt % of C, and a balance of Fe; and a second phase comprising, based on a total weight of said second phase, 3–15 wt % of W, 2–7 wt % of V, 1–7 wt % of Cr, 0.1–0.6 wt % of Si, 0.1–0.6 wt % of Mn, up to 2.2 wt % of C, and a balance of Fe, said second phase being in an amount of from 20 to 80 wt %, based on a total weight of said first and second phases, wherein said first and second phases are distributed in said sintered alloy, in a form of spots.

3. A high-temperature wear-resistant sintered alloy comprising, based on a total weight of said sintered alloy, 3–13.4 wt % of W, 0.4–5.6 wt % of V, 0.2–5.6 wt % of Cr, 0.1–0.6 wt % of Si, 0.2–1.0 wt % of Mn, 0.1–0.6 wt % of S, 0.6–2.2 wt % of C, and a balance of Fe, said sintered alloy including:

a first phase comprising, based on a total weight of said first phase, 3–7 wt % of W, up to 1 wt % of Cr, 0.1–0.6 wt % of Si, 0.2–1.0 wt % of Mn, 0.1–0.6 wt % of S, up to 2.2 wt % of C, and a balance of Fe; and a second phase comprising, based on a total weight of said second phase, 3–15 wt % of W, 2–7 wt % of V, 1–7 wt % of Cr, 0.1–0.6 wt % of Si, 0.2–1.0 wt % of Mn, 0.1–0.6 wt % of S, up to 2.2 wt % of C, and a balance of Fe, said second phase being in an amount of from 20 to 80 wt %, based on a total weight of said first and second phases, wherein said first and second phases are distributed in said sintered alloy, in a form of spots.

4. A high-temperature wear-resistant sintered alloy comprising, based on a total weight of said sintered alloy, 3–13.4 wt % of W, 0.8–5.9 wt % of V, 0.2–5.6 wt % of Cr, 0.1–0.6 wt % of Si, 0.2–1.0 wt % of Mn, 0.1–0.6 wt % of S, 0.6–2.2 wt % of C, and a balance of Fe, said sintered alloy including:

a first phase comprising, based on a total weight of said first phase, 3–7 wt % of W, 0.5–1.5 wt % of V, up to 1 wt % of Cr, 0.1–0.6 wt % of Si, 0.2–1.0 wt % of Mn, 0.1–0.6 wt % of S, up to 2.2 wt % of C, and a balance of Fe; and a second phase comprising, based on a total weight of said second phase, 3–15 wt % of W, 2–7 wt % of V, 1–7 wt % of Cr, 0.1–0.6 wt % of Si, 0.2–1.0 wt % of Mn, 0.1–0.6 wt % of S, up to 2.2 wt % of C, and a balance of Fe, said second phase being in an amount of from 20 to 80 wt %, based on a total weight of said first and second phases, wherein said first and second phases are distributed in said sintered alloy, in a form of spots.

5. A high-temperature wear-resistant sintered alloy comprising, based on a total weight of said sintered alloy, 3–13.4 wt % of W, 0.4–5.6 wt % of V, 0.2–5.6 wt % of Cr, 0.6–5.0 wt % of Si, 0.1–0.6 wt % of Mn, 0.6–2.2 wt % of C, and a balance of Fe, said sintered alloy including:

a first phase comprising, based on a total weight of said first phase, 3–7 wt % of W, up to 1 wt % of Cr, 0.6–5.0 wt % of Si, 0.1–0.6 wt % of Mn, up to 2.2 wt % of C, and a balance of Fe; and a second phase comprising, based on a total weight of said second phase, 3–15 wt % of W, 2–7 wt % of V, 1–7 wt % of Cr, 0.6–5.0 wt % of Si, 0.1–0.6 wt % of Mn, up to 2.2 wt % of C, and a balance of Fe, said second phase being in an amount of from 20 to 80 wt %, based on a total weight of said first and second phases, wherein said first and second phases are distributed in said sintered alloy, in a form of spots.

6. A high-temperature wear-resistant sintered alloy comprising, based on a total weight of said sintered alloy, 3–13.4 wt % of W, 0.8–5.9 wt % of V, 0.2–5.6 wt % of Cr, 0.6–5.0 wt % of Si, 0.1–0.6 wt % of Mn, 0.6–2.2 wt % of C, and a balance of Fe, said sintered alloy including:

a first phase comprising, based on a total weight of said first phase, 3–7 wt % of W, 0.5–1.5 wt % of V, up to 1 wt % of Cr, 0.6–5.0 wt % of Si, 0.1–0.6 wt % of Mn, up to 2.2 wt % of C, and a balance of Fe; and a second phase comprising, based on a total weight of said second phase, 3–15 wt % of W, 2–7 wt % of V, 1–7 wt % of Cr, 0.6–5.0 wt % of Si, 0.1–0.6 wt % of Mn, up to 2.2 wt % of C, and a balance of Fe, said second phase being in an amount of from 20 to 80 wt %, based on a total weight of said first and second phases, wherein said first and second phases are distributed in said sintered alloy, in a form of spots.

7. A high-temperature wear-resistant sintered alloy comprising, based on a total weight of said sintered alloy, 3–13.4 wt % of W, 0.4–5.6 wt % of V, 0.2–5.6 wt % of Cr, 0.6–5.0 wt % of Si, 0.2–1.0 wt % of Mn, 0.1–0.6 wt % of S, 0.6–2.2 wt % of C, and a balance of Fe, said sintered alloy including:

a first phase comprising, based on a total weight of said first phase, 3–7 wt % of W, up to 1 wt % of Cr, 0.6–5.0 wt % of Si, 0.2–1.0 wt % of Mn, 0.1–0.6 wt % of S, up to 2.2 wt % of C, and a balance of Fe; and a second phase comprising, based on a total weight of said second phase, 3–15 wt % of W, 2–7 wt % of V, 1–7 wt % of Cr, 0.6–5.0 wt % of Si, 0.2–1.0 wt % of Mn, 0.1–0.6 wt % of S, up to 2.2 wt % of C, and a balance of Fe, said second phase being in an amount of from 20 to 80 wt %, based on a total weight of said first and second phases, wherein said first and second phases are distributed in said sintered alloy, in a form of spots.

8. A high-temperature wear-resistant sintered alloy comprising, based on a total weight of said sintered alloy, 3–13.4 wt % of W, 0.8–5.9 wt % of V, 0.2–5.6 wt % of Cr, 0.6–5.0 wt % of Si, 0.2–1.0 wt % of Mn, 0.1–0.6 wt % of S, 0.6–2.2 wt % of C, and a balance of Fe, said sintered alloy including:

a first phase comprising, based on a total weight of said first phase, 3–7 wt % of W, 0.5–1.5 wt % of V, up to 1 wt % of Cr, 0.6–5.0 wt % of Si, 0.2–1.0 wt % of Mn, 0.1–0.6 wt % of S, up to 2.2 wt % of C, and a balance of Fe; and a second phase comprising, based on a total weight of said second phase, 3–15 wt % of W, 2–7 wt % of V, 1–7 wt % of Cr, 0.6–5.0 wt % of Si, 0.2–1.0 wt % of Mn, 0.1–0.6 wt % of S, up to 2.2 wt % of C, and a balance of Fe, said second phase being in an amount of from 20 to 80 wt %, based on a total weight of said first and second phases, wherein said first and second phases are distributed in said sintered alloy, in a form of spots.

9. A sintered alloy according to claim 1, wherein said sintered alloy comprises 0.3–1.6 wt % of MnS that is distributed in a boundary between a first grain of said first phase and a second grain of said second phase and/or in a pore of said sintered alloy.

10. A sintered alloy according to claim 1, wherein said sintered alloy further comprises a metal that is one of metallic copper and a copper alloy, said metal being incorporated into said sintered alloy by infiltrating a pore of said sintered alloy with a melt of said metal.

11. A sintered alloy according to claim 1, wherein said sintered alloy further comprises a metal that is one of metallic lead and a lead alloy, said metal being incorporated into said sintered alloy by impregnating a pore of said sintered alloy with a melt of said metal.

12. A sintered alloy according to claim 1, wherein said sintered alloy further comprises an acrylic resin incorporated into said sintered alloy by impregnating a pore of said sintered alloy with a melt of said acrylic resin.

13. A sintered alloy according to claim 1, wherein a first grain of said first phase and a second grain of said second phase have an average particle diameter of from 20 to 150 $\mu$m.

* * * * *